US005530225A

United States Patent [19]

Hajaligol

[11] Patent Number: 5,530,225

[45] Date of Patent: Jun. 25, 1996

[54] INTERDIGITATED CYLINDRICAL HEATER FOR USE IN AN ELECTRICAL SMOKING ARTICLE

[75] Inventor: Mohammad R. Hajaligol, Richmond, Va.

[73] Assignee: Philip Morris Incorporated, New York, N.Y.

[21] Appl. No.: 333,470

[22] Filed: Nov. 2, 1994

Related U.S. Application Data

[63] Continuation-in-part of Ser. No. 224,848, Apr. 8, 1994, which is a continuation-in-part of Ser. No. 118,665, Sep. 10, 1993, Pat. No. 5,388,594, which is a continuation-in-part of Ser. No. 943,504, Sep. 11, 1992, which is a continuation-in-part of Ser. No. 666,926, Mar. 11, 1991, abandoned, which is a continuation of Ser. No. 12,799, Feb. 2, 1993.

[51] Int. Cl.[6] ..... H05B 3/58; A24F 1/22

[52] U.S. Cl. ..... 219/535; 219/553; 131/194

[58] Field of Search ..... 219/535, 542, 219/552–553; 131/194, 197; 128/202.21, 203.27; 338/310, 312, 320; 392/386

[56] References Cited

U.S. PATENT DOCUMENTS

| | | | |
|---|---|---|---|
| 2,971,039 | 2/1961 | Western | 219/553 |
| 4,503,319 | 3/1985 | Moritoki | 219/553 |
| 4,732,168 | 3/1988 | Resce | 131/194 |
| 4,788,077 | 11/1988 | Kang . | |
| 5,060,671 | 10/1991 | Counts et al. | 131/329 |
| 5,095,921 | 3/1992 | Losee et al. | 131/194 |
| 5,157,242 | 10/1992 | Hetherington | 219/553 |
| 5,224,498 | 7/1993 | Deevi et al. | 131/194 |
| 5,235,157 | 8/1993 | Blackburn | 219/268 |
| 5,249,586 | 10/1993 | Morgan | 128/203.27 |
| 5,274,214 | 12/1993 | Blackburn | 219/268 |
| 5,285,050 | 2/1994 | Blackburn | 219/268 |
| 5,322,075 | 6/1994 | Deevi et al. . | |
| 5,353,813 | 10/1994 | Deevi | 219/553 |
| 5,388,594 | 2/1995 | Counts | 128/203.27 |

OTHER PUBLICATIONS

Amin "Arc Spray Coatings Using Inert Gases," TWI Bulletin 6, pp. 129–132, Nov./Dec. 1992.

Blunt et al, "High Velocity Spraying for Electronic Substrates," TWI Connect—World Centre for Materials Joining Technology, No. 40, Dec. 1992.

Filmer et al, "Plasma Spray Deposition of Alumina–Based Ceramic," Ceramic Bulletin, vol. 69, No. 12, pp. 1955–1958, 1990.

Herman, "Coatings and Coating Practices," Advanced Materials & Processes, pp. 59–60, 84–85, Jan. 1990.

Herman, "Plasma–Sprayed Coatings," Scientific American, pp. 112–116, 1988.

Herman, "Plasma Spray Deposition Processes," MRS Bulletin, pp. 60–67, 1988.

Sampath et al, "Microstructure and Properties of Plasma–Spray Consolidated/Two–Phase Nickel Aluminides," vol. 25, pp. 1425–1430, 1991.

(List continued on next page.)

*Primary Examiner*—Teresa J. Walberg
*Assistant Examiner*—Sam Paik
*Attorney, Agent, or Firm*—Kevin B. Osborne; James E. Schardt; Charles E. B. Glenn

[57] ABSTRACT

A heater having a generally cylindrical or tubular configuration comprised of a selected plurality of thermally conductive heater blades and adjacent heat sink and aerosol barrier blades interposed between the heater blades to form an interdigitated structure. A respective gap is defined between a heater blade and an adjacent heat sink blade to prevent heat loss during an electrical pulse which heats the heater blade. During the subsequent cooling period and puff interval, the adjacent heat sink blades prevent heat from propagating to other parts of the aerosol generating tube, i.e., the cigarette. In addition to the thermal function, the barrier blades also block the escape of moisture generated by the aerosol generating medium, thereby limiting the propagation of condensation. The respective gaps between the interdigitated blades are defined to be wide enough to prevent heat losses during pulsing from a heater blade to adjacent blades yet small enough to prevent escape of significant amounts of vapor.

49 Claims, 12 Drawing Sheets

OTHER PUBLICATIONS

Sampath et al, "Structure and Properties of Vacuum Plasma Sprayed Hard Coatings," Memories et Etudes Scientifiques Revue de Metallurgie, pp. 289–294, Mai 1991.

Srivatsan et al, "Review Use of Spray Techniques to Synthesize Particulate–Reinforced Metal–Matrix Composites," Journal of Materials Science 27, pp. 5965–5981, 1992.

Street et al, "Trends In Laser Cutting of Advanced Materials," TWI Bulletin 5, pp. 108–111, Sep./Oct. 1992.

Tiwari et al, Spray Forming of $MoSi_2$ and $MoSi_2$–Based Composites, Mat. Res. Soc. Symp. Proc., vol. 213, Materials Research Society, pp. 807–813, 1991.

Tiwari et al, "Thermal Spray Forming of Particulate Composites," Dept. of Mat. Sci. & Engineering, State University of New York, Stony Brook, NY 11794–2275 and Flame Spray Industries, Inc., 152 Haven Ave., Port Washington, NY 11050.

Tiwari et al, "Incorporating of Reinforcements in Spray Formed MMCs", Department of Materials Science and Engineering, State University of New York, Stony Brook, NY 11794–2275.

Travis, "Making Materials That Are Good to the Last Drop," Research News, vol. 258, p. 1307, Nov. 1992.

Wang et al, "Activation Energy for Crystal Growth Using Isothermal and Continuous Heating Processes", Journal of Materials Science, Chapman and Hall, vol. 25, pp. 2339–2343, 1990.

Wang et al, "Thermomechanical Properties of Plasma–Sprayed Oxides in the $MgO–Al_2O_3–SiO_2$ system," Surface and Coatings Technology, vol. 42, pp. 203–216, 1990.

Wu et al, "Heat Transfer to a Particle in a Thermal Plasma," Trans IChemE, vol. 69, Part A, pp. 21–24, Jan. 1991.

Zaat, "A Quarter of a Century of Plasma Spraying," Ann Rev. Mater. Sci.by Annual Reviews, Inc., pp. 13:9–42, 1983.

Zatorski et al, "Wear of Plasma–Sprayed Alumina–Titania Coatings," High Performance Ceramic Films and Coatings by Elsevier Science Publishers B. V., pp., 591–601, 1991.

Fen et al., "Cyclic Oxidation of Haynes 230 alloy," Chapman & Hall, pp. 1514–1520 (1992).

Reinshagen and Sikka, "Thermal Spraying of Selected Aluminides," Proceedings of the Fourth National Thermal Spray Conference, Pittsburgh, PA, USA, pp. 307–313, (4–10 May 1991).

Kutner, "Thermal Spray by Design," Reprint from Advanced Materials & Processes incorporating Metal Progress, Oct. (1988).

"Characterizing THERMAL SPRAY COATINGS," article based on presentations made at the fourth National Thermal Spray Conference, 4–10 May (1991) and which appeared in "Advanced Materials and Processes," May 1992, pp. 23–27.

Howes, Jr., "Computerized Plasma Control for Applying Medical–Quality Coatings," Industrial Heating, pp. 22–25, Aug., 1993.

INTERDIGITATED CYLINDRICAL HEATER FOR USE IN AN ELECTRICAL SMOKING ARTICLE

Cross Reference to Related Applications

The present application is a continuation-in-part of commonly assigned patent application Ser. No. 08/224,848, filed Apr. 8, 1994, entitled "Tubular Heater for Use in an Electrical Smoking Article" which is a continuation-in-part of patent application Ser. No. 08/118,665, filed Sep. 10, 1993, now U.S. Pat. No. 5,388,594 which in turn is a continuation-in-part of commonly assigned patent application No. 07/943,504, filed Sep. 11, 1992, which in turn is a continuation-in-part of patent application Ser. No. 07/666,926 filed Mar. 11, 1991, now abandoned in favor of filewrappper continuation application Ser. No. 08/012,799 filed Feb. 2, 1993. The present application also relates to commonly assigned copending patent application Ser. No. 07/943,747, filed Sep. 11, 1992 and to commonly assigned U.S. Pat. No. 5,060,671, issued Oct. 29, 1991; U.S. Pat. No. 5,095,921, issued Mar. 17, 1992; and U.S. Pat. No. 5,224,498, issued Jul. 6, 1992; which are hereby incorporated by reference.

BACKGROUND OF THE INVENTION

1. Technical Field of the Invention

Previously known conventional smoking devices deliver flavor and aroma to the user as a result of combustion of tobacco. A mass of combustible material, primarily tobacco, is oxidized as the result of applied heat with typical combustion temperatures in a conventional cigarette being in excess of 800° C. during puffing. Heat is drawn through an adjacent mass of tobacco by drawing on the mouth end. During this heating, inefficient oxidation of the combustible material takes place and yields various distillation and pyrolysis products. As these products are drawn through the body of the smoking device toward the mouth of the user, they cool and condense to form an aerosol or vapor which gives the consumer the flavor and aroma associated with smoking.

Conventional cigarettes have various perceived drawbacks associated with them. Among them is the production of sidestream smoke during smoldering between puffs, which may be objectionable to some nonsmokers. Also, once lit, they must be fully consumed or be discarded. Relighting a conventional cigarette is possible but is usually an unattractive prospect for subjective reasons (flavor, taste, odor) to a discerning smoker.

A prior alternative to the more conventional cigarettes include those in which the combustible material itself does not directly provide the flavorants to the aerosol inhaled by the smoker. In these smoking articles, a combustible heating element, typically carbonaceous in nature, is combusted to heat air as it is drawn over the heating element and through a zone which contains heat-activated elements that release a flavored aerosol. While this type of smoking device produces little or no sidestream smoke, it still generates products of combustion, and once lit it is not adapted to be snuffed for future use in the conventional sense.

In both the more conventional and carbon element heated smoking devices described above combustion takes place during their use. This process naturally gives rise to many byproducts as the combusted material breaks down and interacts with the surrounding atmosphere.

Commonly assigned U.S. Pat. Nos. 5,093,894; 5,225,498; 5,060,671 and 5,095,921 disclose various electrical resistive heating elements and flavor generating articles which significantly reduce sidestream smoke while permitting the smoker to selectively suspend and reinitiate smoking. However, the cigarette articles disclosed in these patents are not very durable and may collapse, tear or break from extended or heavy handling. In certain circumstances, these prior cigarette articles may crush as they are inserted into the electric lighters. Once they are smoked, they are even weaker and may tear or break as they are removed from the lighter.

U.S. patent application Ser. No. 08/118,665, filed Sep. 10, 1993, describes an electrical smoking system including a novel electrically powered lighter and novel cigarette that is adapted to cooperate with the lighter. The preferred embodiment of the lighter includes a plurality of metallic sinusoidal heaters disposed in a configuration that slidingly receives a tobacco rod portion of the cigarette.

The preferred embodiment of the cigarette of Ser. No. 08/118,665 preferably comprises a tobacco-laden tubular carrier, cigarette paper overwrapped about the tubular carrier, an arrangement of flow-through filter plugs at a mouthpiece end of the carrier and a filter plug at the opposite (distal) end of the carrier, which preferably limits air flow axially through the cigarette. The cigarette and the lighter are configured such that when the cigarette is inserted into the lighter and as individual heaters are activated for each puff, localized charring occurs at spots about the cigarette in the locality where each heater was bearing against the cigarette. Once all the heaters have been activated, these charred spots are closely spaced from one another and encircle a central portion of the carrier portion of the cigarette. Depending on the maximum temperatures and total energies delivered at the heaters, the charred spots manifest more than mere discolorations of the cigarette paper. In most applications, the charring will create at least minute breaks in the cigarette paper and the underlying carrier material, which breaks tends to mechanically weaken the cigarette. For the cigarette to be withdrawn from the lighter, the charred spots must be at least partially slid past the heaters. In aggravated circumstances, such as when the cigarette is wet or toyed with or twisted, the cigarette may be prone to break or leave pieces upon its withdrawal from the lighter. Pieces left in the lighter fixture can interfere with the proper operation of the lighter and/or deliver an off-taste to the smoke of the next cigarette. If the cigarette breaks in two while being withdrawn, the smoker may be faced not only with the frustration of failed cigarette product, but also with the prospect of clearing debris from a clogged lighter before he or she can enjoy another cigarette.

The preferred embodiment of the cigarette of Ser. No. 08/118,665 is essentially a hollow tube between the filter plugs at the mouthpiece end of the cigarette and the plug at the distal end. This construction is believed to elevate delivery to the smoker by providing sufficient space into which aerosol can evolve off the carrier with minimal impingement and condensation of the aerosol on any nearby surfaces.

Several proposals have been advanced which significantly reduce undesired sidestream smoke while permitting the smoker to suspend smoking of the article for a desired period and then to resume smoking. For example, commonly assigned U.S. Pat. Nos. 5,093,894; 5,225,498; 5,060,671 and 5,095,921 disclose various heating elements and flavor generating articles. Grandparent application Ser. No. 08/118,665 discloses an electrical smoking article having heaters which are actuated upon sensing of a draw by control and logic circuitry. The heaters are preferably a relatively thin serpentine structure to transfer adequate amounts of heat to the cigarette and is lightweight.

Although these devices and heaters overcome the observed problems and achieve the stated objectives, many embodiments are plagued by the formation of a significant amount of condensation formed as the tobacco flavor medium is heated to form vapors. These vapors can cause problems as they condense on relatively cooler various electrical contacts and the associated control and logic circuitry. In addition, condensation can influence the subjective flavor of the tobacco medium of the cigarette. Though not desiring to be bound by theory, it is believed that the condensation is the result of the flow pattern and pressure gradient of ambient air drawn through the article and the current designs of the heater assemblies. The heating of the tobacco flavor medium releases vapors which are then cooled to result in condensation on the surfaces of relatively cooler components. The condensation can cause shorting and other undesired malfunctions.

In addition, the proposed heaters are subject to mechanical weakening and possible failure due to stresses induced by inserting and removing the cylindrical tobacco medium and also by adjusting or toying with the inserted cigarette.

Also, the electrical smoking articles employ electrically resistive heaters which have necessitated relatively complex electrical connections which can be disturbed by insertion and removal of the cigarette.

OBJECTS OF THE INVENTION

It is accordingly an object of the present invention to provide a heater which generates smoke from a tobacco medium without sustained combustion.

It is another object of the present invention to provide a heater for a smoking article which reduces the creation of undesired sidestream smoke.

It is yet another object of the present invention to provide a heater for a smoking article which permits the smoker to suspend and resume use.

It is a further object of the present invention to accomplish the foregoing objects while reducing aerosol or smoke condensation within the smoking article.

It is yet another object of the present invention to provide a heater structure which provides a desired number of puffs and which is straightwardly modified to change the number and or duration of puffs provided without sacrificing subjective qualities of the tobacco.

It is another object of the present invention to provide a method of making such a heater to accomplish the foregoing objects.

It is a further object of the present invention to provide a heating element for a smoking article which is mechanically suitable for insertion and removal of a cigarette.

It is another object of the present invention to simplify connections of an electrically resistive heater to an associated power source.

It is a further object of the present invention to provide such a heater which is more economical to manufacture.

It is another object of the present invention to accomplish the foregoing objects simply and in a straightforward manner.

Additional objects and advantages of the present invention are apparent from the drawings and specification which follow.

SUMMARY OF THE INVENTION

The foregoing and additional objects are obtained by a heater according to the present invention. The heater has a generally cylindrical or tubular configuration comprised of a selected plurality of thermally conductive heater blades bearing heaters and a plurality of adjacent heat sink—aerosol barrier blades interposed between the heater blades to form an interdigitated structure. A respective gap is defined between a heater blade and an adjacent heat sink blade to prevent heat loss during an electrical pulse which heats the heater disposed on the heater blade. During the subsequent cooling period and puff interval, the adjacent heat sink blades prevent heat from propagating to other parts of the aerosol generating tube, i.e., the cigarette. In addition to the thermal insulating function, the barrier blades also block the escape of moisture generated by the aerosol generating medium, thereby limiting the propagation of condensation. The respective gaps between the interdigitated blades are defined to be wide enough to prevent heat losses during pulsing from a heater blade to adjacent blades and associated portion of the cigarette and to permit a transverse air flow, yet small enough to prevent escape of significant amounts of vapor.

This heater structure according to the present invention is fabricated by a number of methods. One method includes cutting a thermally insulating ceramic tube into two mating pieces, each piece having a plurality of blades. The blades of one piece are configured as heaters by depositing a heating material and leads thereon. Alternatively, the heating element piece is made by cutting blades from a sheet and rolling the cut sheet into a cylinder for mating with the ceramic piece having heat sink blades. In another embodiment, a ceramic tube is cut axially to form a plurality of discrete areas of blades with a single, and optionally a second, hub at an end of the tube. Alternate discrete areas are deposited with a conductive heating material. The interposed areas are used as heat sinks and aerosol barriers and may also serve as part of the electrical conduction path. Alternatively, the ceramic tube is cut axially to form a desired number of heat sink-aerosol barrier blades with interposed slots. Heater elements are then cut and suspended in the respective slots.

DETAILED DESCRIPTION OF THE PREFERRED EMBODIMENTS

Figure 1:
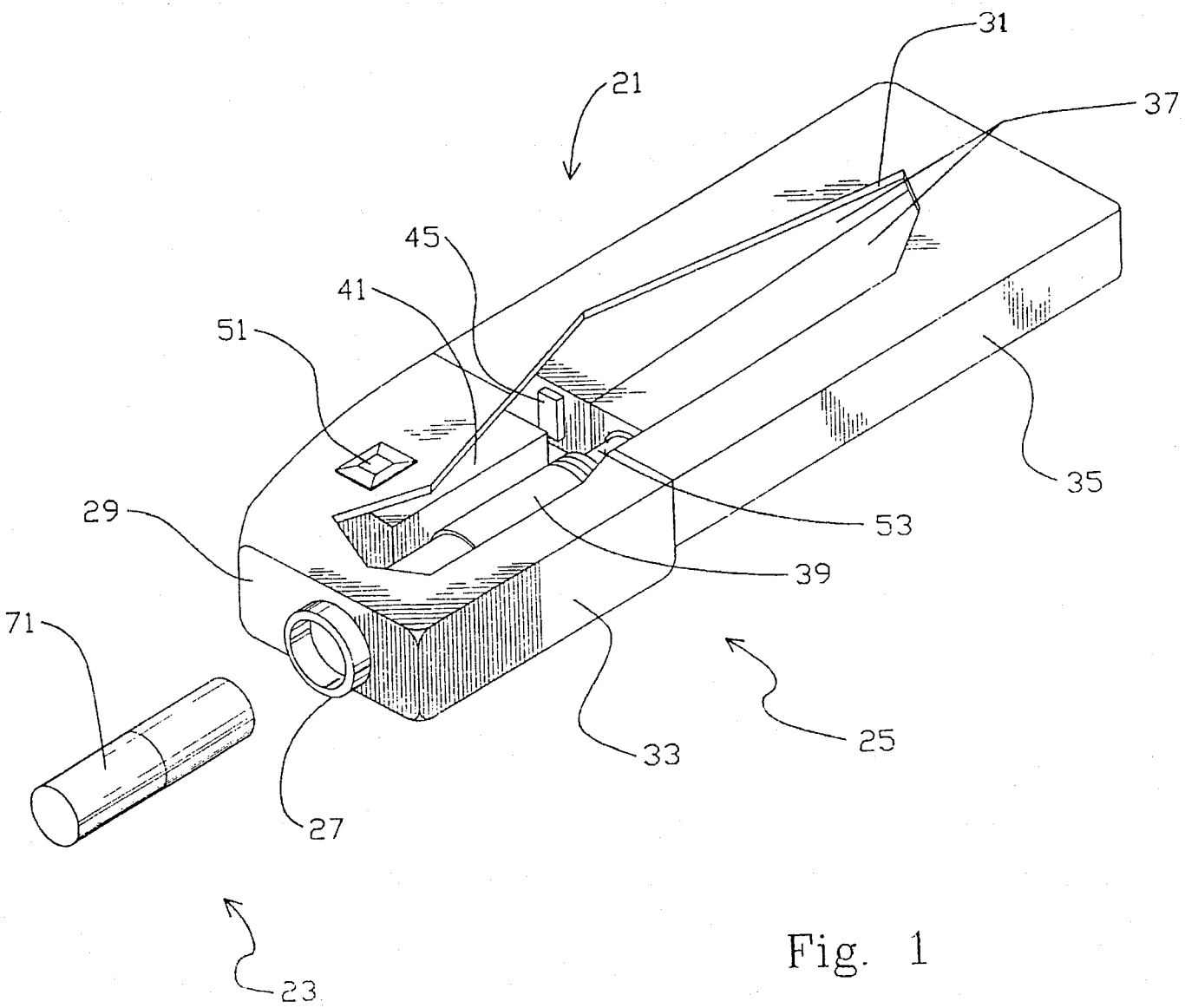
FIG. 1 is a partially exposed perspective view of a smoking article employing a heater according to the present invention.
Figure 2:
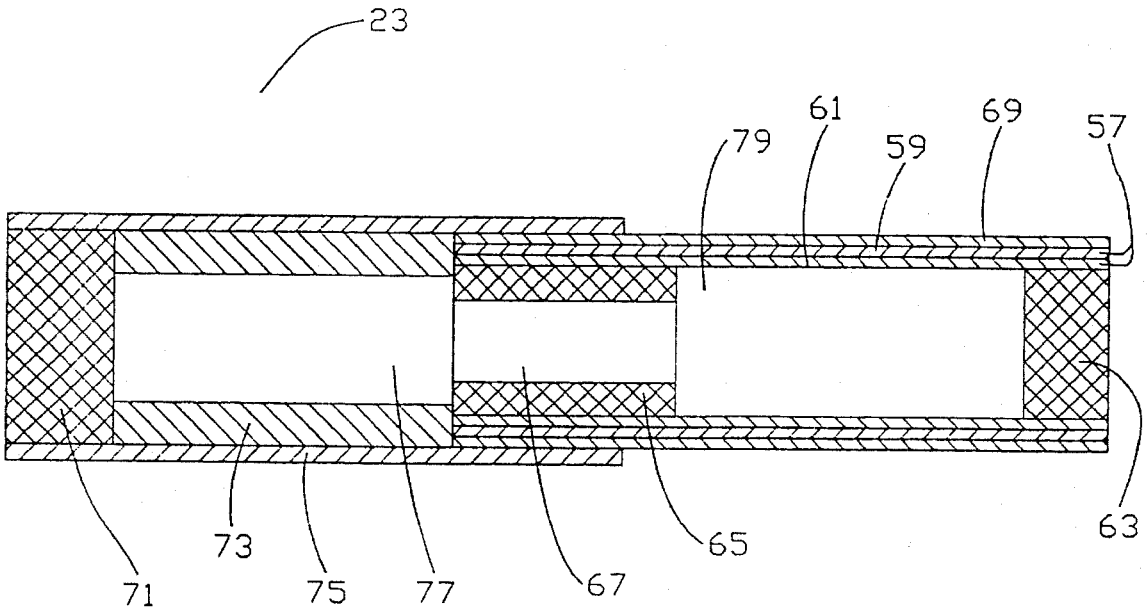
FIG. 2 is a side, cross-sectional view of a cigarette used in conjunction with the present invention.

A smoking system 21 according to the present invention is generally seen with reference to FIGS. 1 and 2. The smoking system 21 includes a cylindrical aerosol generating tube or cigarette 23 and a reusable lighter 25. The cigarette 23 is adapted to be inserted in and removed from an orifice 27 at a front end 29 of the lighter 25. The smoking system 21 is used in much the same fashion as a conventional cigarette. The cigarette 23 is disposed of after one or more puff cycles. The lighter 25 is preferably disposed of after a greater number of puff cycles than the cigarette 23.

The lighter 25 includes a housing 31 and has front and rear portions 33 and 35. A power source 37 for supplying energy to heating elements for heating the cigarette 23 is preferably disposed in the rear portion 35 of the lighter 25. The rear portion 35 is preferably adapted to be easily opened and closed, such as with screws or with snap-fit components, to facilitate replacement of the power source 37. The front portion 33 preferably houses heating elements and circuitry in electrical communication with the power source 37 in the rear portion 35. The front portion 33 is preferably easily joined to the rear portion 35, such as with a dovetail joint or by a socket fit. The housing 31 is preferably made from a hard, heat-resistant material. Preferred materials include metal-based or, more preferably, polymer-based materials. The housing 31 is preferably adapted to fit comfortably in the hand of a smoker and, in a presently preferred embodiment, has overall dimensions of 10.7 cm by 3.8 cm by 1.5 cm.

The power source 37 is sized to provide sufficient power for heating elements that heat the cigarette 23. The power source 37 is preferably replaceable and rechargeable and may include devices such as a capacitor, or more preferably, a battery. In a presently preferred embodiment, the power source is a replaceable, rechargeable battery such as four nickel cadmium battery cells connected in series with a total, non-loaded voltage of approximately 4.8 to 5.6 volts. The characteristics required of the power source 37 are, however, selected in view of the characteristics of other components in the smoking system 21, particularly the characteristics of the heating elements. U.S. Pat. No. 5,144,962 describes several forms of power sources useful in connection with the smoking system of the present invention, such as rechargeable battery sources and quick-discharging capacitor power sources that are charged by batteries, and is hereby incorporated by reference.

Figure 3:
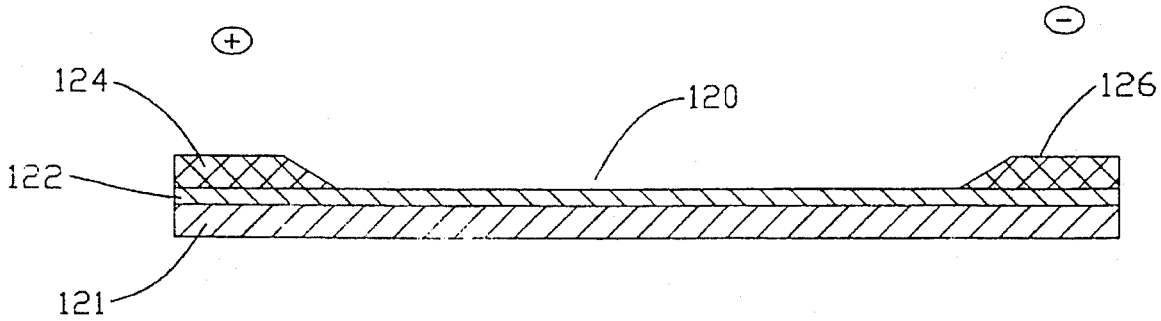
FIG. 3 is a side, cross-sectional view of a heater fixture according to the present invention.

A substantially cylindrical heating fixture 39 for heating the cigarette 23, and, preferably, for holding the cigarette in place relative to the lighter 25, and electrical control circuitry 41 for delivering a predetermined amount of energy from the power source 37 to heating elements (not seen in FIGS. 1 and 2) of the heating fixture are preferably disposed in the front 33 of the lighter. As described in greater detail below, a generally circular, terminal end hub 110 is fixed, e.g., welded, to be disposed within the interior of heater fixture 39, e.g., is fixed to spacer 49, as shown in FIG. 3. If the heater has two end hubs, either hub can serve as the fixed terminal end. In the presently preferred embodiment, the heating fixture 39 includes a plurality of radially spaced heating elements 122 supported to extend from the hub, seen in FIG. 3 and described in greater detail below, that are individually energized by the power source 37 under the control of the circuitry 41 to heat a number of, e.g., eight, areas around the periphery of the inserted cigarette 23. Eight heating elements 122 are preferred to develop eight puffs as in a conventional cigarette and eight heater elements also lend themselves to electrical control with binary devices. A desired number of puffs can be generated, e.g., any number between 5–16, and preferably 6–10 or 8 per inserted cigarette. As discussed below, the number of heaters can exceed the desired number of puffs/cigar The circuitry 41 is preferably activated by a puff-actuated sensor 45, seen in FIG. 1, that is sensitive either to pressure drops that occur when a smoker draws on the cigarette 23. The puff-actuated sensor 45 is preferably disposed in the front 33 of the lighter 25 and communicates with a space inside the heater fixture 39 and near the cigarette 23 through a passageway extending through a spacer and a base of the heater fixture and, if desired, a puff sensor tube (not shown). A puff-actuated sensor 45 suitable for use in the smoking system 21 is described in U.S. Pat. No. 5,060,671, the disclosure of which is incorporated by reference, and is in the form of a Model 163PCO1D35 silicon sensor, manufactured by the MicroSwitch division of Honeywell, Inc., Freeport, Ill., which activates an appropriate one of the heater elements 122 as a result of a change in pressure when a smoker draws on the cigarette 23. Flow sensing devices, such as those using hot-wire anemometry principles, have also been successfully demonstrated to be useful for activating an appropriate one of the heater elements 122 upon detection of a change in air flow.

An indicator 51 is preferably provided on the exterior of the lighter 25, preferably on the front 33, to indicate the number of puffs remaining on a cigarette 23 inserted in the lighter. The indicator 51 preferably includes a seven-segment liquid crystal display. In a presently preferred embodiment, the indicator 51 displays the digit "8" for use with an eight-puff cigarette when a light beam emitted by a light sensor 53, seen in FIG. 1, is reflected off of the front of a newly inserted cigarette 23 and detected by the light sensor. The light sensor 53 is preferably mounted in an opening in the spacer and the base of the heater fixture 39. The light sensor 53 provides a signal to the circuitry 41 which, in turn, provides a signal to the indicator 51. For example, the display of the digit "8" on the indicator 51 reflects that the preferred eight puffs provided on each cigarette 23 are available, i.e., none of the heater elements 43 have been activated to heat the new cigarette. After the cigarette 23 is fully smoked, the indicator displays the digit "0". When the cigarette 23 is removed from the lighter 25, the light sensor 53 does not detect the presence of a cigarette 23 and the indicator 51 is turned off. The light sensor 53 is modulated so that it does not constantly emit a light beam and provide an unnecessary drain on the power source 37. A presently preferred light sensor 53 suitable for use with the smoking system 21 is a Type OPR5005 Light Sensor, manufactured by OPTEX Technology, Inc., 1215 West Crosby Road, Carrollton, Tex. 75006.

As one of several possible alternatives to using the above-noted light sensor 53, a mechanical switch (not shown) may be provided to detect the presence or absence of a cigarette 23 and a reset button (not shown) may be provided for resetting the circuitry 41 when a new cigarette is inserted in the lighter 25, e.g., to cause the indicator 51 to display the digit "8", etc. Power sources, circuitry, puff-actuated sensors, and indicators useful with the smoking system 21 of the present invention are described in U.S. Pat. No. 5,060,671 and U.S. patent application Ser. No. 07/943,504, both of which are incorporated by reference. The passageway and the opening 50 in the spacer and the heater fixture base are preferably air-tight during smoking.

A presently preferred cigarette 23 for use with the smoking system 21 will now be described and is shown in greater detail in grandparent application Ser. No. 08/118,665, although the cigarette may be in any desired form capable of generating a flavored tobacco response for delivery to a smoker when the cigarette is heated by the heating elements 122. Referring to FIG. 2, the cigarette 23 includes a tobacco web 57 formed of a carrier or plenum 59 which supports tobacco flavor material 61, preferably including tobacco. The tobacco web 57 is wrapped around and supported by a cylindrical back-flow filter 63 at one end and a cylindrical first free-flow filter 65 at an opposite end. The first free-flow filter 65 is preferably an "open-tube" type filter having a longitudinal passage 67 extending through the center of the first free-flow filter and, hence, provides a low resistance to draw or free flow.

If desired, cigarette overwrap paper 69 is wrapped around the tobacco web 57. Types of paper useful as the overwrap paper 69 include a low basis weight paper, preferably a paper with a tobacco flavor coating, or a tobacco-based paper to enhance the tobacco flavor of a flavored tobacco response. A concentrated extract liquor in full or diluted strength may be coated on the overwrap paper 69. The overwrap paper 69 preferably possesses a minimal base weight and caliper while providing sufficient tensile strength for machine processes. Presently preferred characteristics of a tobacco-based paper include a basis weight (at 60% relative humidity) of between 20–25 grams/m$^2$, minimum permeability of 0–25 CORESTA (defined as the amount of air, measured in cubic centimeters, that passes through one square centimeter of material, e.g., a paper sheet, in one minute at a pressure drop of 1.0 kilopascal), tensile strength >2000 grams/27 mm width (1 in/min), caliper 1.3–1.5 mils, $CaCO_3$ content ≦5%, citrate 0%. Materials for forming the overwrap paper 69 preferably include >75% tobacco-based sheet (non-cigar, flue- or flue-/air-cured mix filler and bright stem). Flax fiber in amounts no greater than that necessary to obtain adequate tensile strength may be added. The overwrap paper 69 can also be conventional flax fiber paper of basis weight 15–20 g/m$^2$ or such paper with an extract coating. Binder in the form of citrus pectin may be added in amounts less than or equal to 1%. Glycerin in amounts no greater than necessary to obtain paper stiffness similar to that of conventional cigarette paper may be added.

The cigarette 23 also preferably includes a cylindrical mouthpiece filter 71, which is preferably a conventional RTD-type (Resistance To Draw) filter, and a cylindrical second free-flow filter 73. The mouthpiece filter and the second free-flow filter are secured to one another by tipping paper 75. The tipping paper 75 extends past an end of the second free-flow filter 73 and is attached to the overwrap paper 69 to secure an end of the first free-flow filter 65 in position adjacent an end of the second free-flow filter 73. Like the first free-flow filter 65, the second free-flow filter 73 is preferably formed with a longitudinal passage 77 extending through its center. The back-flow filter 63 and the first free-flow filter 65 define, with the tobacco web 57, a cavity 79 within the cigarette 23.

It is preferred that the inside diameter of the longitudinal passage 77 of the second free-flow filter 73 be larger than the inside diameter of the longitudinal passage 67 of the first free-flow filter 65. Presently preferred inside diameters for the longitudinal passage 67 are between 1–4 mm and for the longitudinal passage 77 are between 2–6 mm. It has been observed that the different inside diameters of the passages 67 and 77 facilitates development of a desirable mixing or turbulence between the aerosol developed from the heated tobacco flavor material and air drawn in from outside the cigarette 23 during drawing on the cigarette, resulting in an improved flavored tobacco response and facilitating exposure of more of an end of the mouthpiece filter 71 to the mixed aerosol. The flavored tobacco response developed by heating the tobacco flavor material 61 is understood to be primarily in a vapor phase in the cavity 79 and to turn into a visible aerosol upon mixing in the passage 77. In addition to the above-described first free-flow filter 65 having a longitudinal passage 67, other arrangements capable of generating the desired mixing of the vapor phase flavored tobacco response with introduced air include those in which a first free-flow filter is provided in the form of a filter having a multitude of small orifices, i.e., the first free-flow filter may be in the form of a honeycomb or a metal plate having multiple holes formed therein.

Air is preferably drawn into the cigarette 23 predominantly through the tobacco web 57 and the overwrap paper 69, in a transverse or radial path, and not through the back-flow filter 63 in a longitudinal path. It is desirable to permit air flow through the back-flow filter 63 during a first puff on the cigarette to lower the RTD. It is presently understood that drawing air into the cigarette 23 longitudinally tends to result in the aerosol developed by heating the tobacco web with the heater elements 122 arranged radially around the tobacco web not being properly removed from the cavity 79. It is presently preferred to produce a flavored tobacco response as a function almost entirely of the makeup of the tobacco web 57 and the energy level of the heater elements 122. Accordingly, the portion of the air flow through the cigarette resulting from longitudinal flow through the backflow filter 63 is preferably minimal during smoking, except during the first puff. Further, the back-flow filter 63 preferably minimizes the flow of aerosol in a backward direction out of the cavity 79 after heating of the tobacco flavor material 61, so that the potential for damage to components of the lighter 25 from aerosol flowing backward from the cigarette 23 is minimized.

The carrier or plenum 59 which supports the tobacco flavor material provides a separation between the heating elements 122 and the flavor material, transfers heat generated by the heater elements to the flavor material, and maintains cohesion of the cigarette after smoking. Preferred carriers 59 include those composed of a non-woven carbon fiber mat, preferred because of its thermal stability. Such carriers are discussed in greater detail in U.S. patent application Ser. No. 07/943,504 and copending commonly-assigned U.S. patent application Ser. No. 07/943,747, filed Sep. 11, 1992, which are incorporated by reference.

Other carriers 59 include low mass, open mesh metallic screens or perforated metallic foils. For example, a screen having a mass in the range from about 5 g/m$^2$ to about 15 g/m$^2$ and having wire diameters in the range from about 0.038 mm (about 1.5 mils) to about 0.076 mm (about 3.0 mils) is used. Another embodiment of the screen is formed of a 0.0064 mm (about 0.25 mil)-thick foil (e.g., aluminum) having perforations with diameters in the range from about 0.3 mm to about 0.5 mm, to reduce the mass of the foil by about 30 percent to about 50 percent, respectively. Preferably, the perforation pattern of such a foil is staggered or discontinuous (i.e., not in straight arrangement) to reduce the lateral conduction of heat away from the tobacco flavor material 61. Such metallic screens and foils are incorporated into a cigarette 23 in a variety of ways including, for example, (1) casting a tobacco flavor slurry on a belt and overlaying the screen or foil carrier on the wet slurry prior to drying, and (2) laminating the screen or foil carrier to a tobacco flavor base sheet or mat with a suitable adhesive.

A presently preferred tobacco web 57 is formed using a paper making-type process. In this process, tobacco strip is washed with water. The solubles are used in a later coating step. The remaining (extracted) tobacco fiber is used in the construction of a base mat. Carbon fibers are dispersed in water and sodium alginate is added. Any other hydrocolloid which does not interfere with the flavored tobacco response, is water soluble, and has a suitable molecular weight to impart strength to the tobacco web 57 may be added in lieu of the sodium alginate. The dispersion is mixed with the slurry of extracted tobacco fibers and optional flavors. The resultant mixture is wet-laid onto a fourdrinier wire and the web is passed along the remainder of a traditional paper making machine to form a base web. The solubles removed by washing the tobacco strip are coated onto one side of the base web, preferably by a standard reverse roll coater located after a drum or Yankee dryer. The tobacco solubles/tobacco dust or particulate ratio is preferably varied between a 1:1 and a 20:1 ratio. The slurry may also be cast or extruded onto the base mat. Alternatively, the coating step is produced off-line. During or after the coating step, flavors that are conventional in the cigarette industry are added. Pectin or another hydrocolloid is added, preferably in a range of between 0.1 to 2.0%, to improve the coatability of the slurry.

Whichever type of carrier 59 is used, tobacco flavor material 61 which is disposed on the inner surface of the carrier liberates flavors when heated and is able to adhere to the surface of the carrier. Such materials include continuous sheets, foams, gels, dried slurries, or dried spray-deposited slurries, which preferably, although not necessarily, contain tobacco or tobacco-derived materials, and which are more fully discussed in the above-incorporated U.S. patent application Ser. No. 07/943,747.

Preferably, a humectant, such as glycerin or propylene glycol, is added to the tobacco web 57 during processing in amounts equalling between 0.5% and 10% of humectant by the weight of the web. The humectant facilitates formation of a visible aerosol by acting as an aerosol precursor. When a smoker exhales an aerosol containing the flavored tobacco response and the humectant, the humectant condenses in the atmosphere, and the condensed humectant provides the appearance of conventional cigarette smoke.

The cigarette 23 is preferably a substantially constant diameter along its length and, like conventional cigarettes, is preferably between approximately 7.5 mm and 8.5 mm in diameter so that a smoker has a similar "mouth feel" with the smoking system 21 as with a conventional cigarette. In the presently preferred embodiment, the cigarette 23 is 58 mm in length, overall, thereby facilitating the use of conventional packaging machines in the packaging of such cigarettes. The combined length of the mouthpiece filter 71 and the second free-flow filter 73 is preferably 30 mm. The tipping paper 75 preferably extends 5 mm past the end of the second free-flow filter 73 and over the tobacco web 57. The length of the tobacco web 57 is preferably 28 mm. The tobacco web 57 is supported at opposite ends by the back-flow filter 63 which is preferably 7 mm in length, and the first free-flow filter 65, which is preferably 7 mm in length. The cavity 79 defined by the tobacco web 57, the back-flow filter 63, and the first free-flow filter 65 is preferably 14 mm in length.

When the cigarette 23 is inserted in the orifice 27 in the first end 29 of the lighter 25, it abuts or nearly abuts an inner bottom surface 81 of the spacer 49 of the heater fixture at hub 110, seen in FIG. 3, adjacent the passageway 47 communicating with the puff-actuated sensor 45 and the opening 55 for the light sensor 53. In this position, the cavity 79 of the cigarette 23 is preferably adjacent the heater blades 120 and substantially all of that portion of the cigarette including the second free-flow filter 73 and the mouthpiece filter 71 extends outside of the lighter 25. Portions of the heater blades 120 are preferably biased radially inward or define a smaller receptacle diameter than the cigarette to facilitate holding the cigarette 23 in position relative to the lighter 25 and so that they are in a thermal transfer relationship with the tobacco web 57, either directly or through the overwrap paper 69. Accordingly, the cigarette 23 is preferably compressible to facilitate permitting the heater blades 120 to press into the sides of the cigarette. The remaining elements of heater fixture 39 are identical to these described in the great grandparent application Ser. No. 07/943,504.

Air flow through the cigarette 23 is accomplished in several ways. For example, in the embodiment of the cigarette 23 shown in FIG. 2, the overwrap paper 69 and the tobacco web 57 are sufficiently air permeable to obtain a desired RTD such that, when a smoker draws on the cigarette, air flows into the cavity 79 transversely or radially through the overwrap paper and the tobacco web. As noted above, an air-permeable back-flow filter 69 may be used to provide longitudinal air flow into the cavity 79.

If desired, transverse air flow into the cavity 79 is facilitated by providing a series of radial perforations (not shown) through the overwrap paper 69 and the tobacco web 57 in one or more regions adjacent the cavity. Such perforations have been observed to improve the flavored tobacco response and aerosol formation. Perforations having a density of approximately 1 hole per 1–2 square millimeters and a hole diameter of between 0.4 mm and 0.7 mm are provided through the tobacco web 57. This results in preferred CORESTA porosity of between 100–500. The overwrap paper 69, after perforation, preferably has a permeability of between 100 and 1000 CORESTA. Of course, to achieve desired smoking characteristics, such as resistance to draw, perforation densities and associated hole diameters other than those described above may be used.

Transverse air flow into the cavity 79 is also facilitated by providing perforations (not shown) through both the overwrap paper 69 and the tobacco web 57. In forming a cigarette 23 having such perforations, the overwrap paper 69 and the tobacco web 57 are attached to one another and then perforated together or are perforated separately and attached to one another such that the perforations in each align or overlap.

Presently preferred heater embodiments are show in FIGS. 3–11. These heaters provide improved mechanical strength for the repeated insertions, adjustments and removals of cigarettes 23 and significantly reduce the escape of aerosols from a heated cigarette to decrease exposure of sensitive components to condensation. If provisions are not made to control condensation, the generated aerosols in the air will tend to condense on relatively cool surfaces such as heater ends, the outer sleeve, electrical connections, control and logic circuitry, etc., potentially degrading or disabling the smoking article. It has been found that the generated aerosols tend to flow radially inward away from a pulsed heater.

FIG. 3 shows an exposed side view of a heater blade 120 comprising a ceramic substrate 121 having a electrically resistive heating element 122 deposit thereon. An appropriate positive contact pad 124 and a negative contact pad 126 are deposited on heating element 122 in electrical contact herewith. Although FIG. 3 shows heating element 122 extending to the end of heater blade 120 where negative contact pad 126 is located, in an optional embodiment only contact pad 126 is located at this end and heating element 122 terminates prior to the end while establishing an electrical connection with contact pad 126, i.e., pad 126 does not overlie the heating element 122. Positive contact pad 124 can be similarly arranged. Preferably, the heating element 122 and the contact pads 124, 126 are respectively deposited via masks.

Figure 4A:
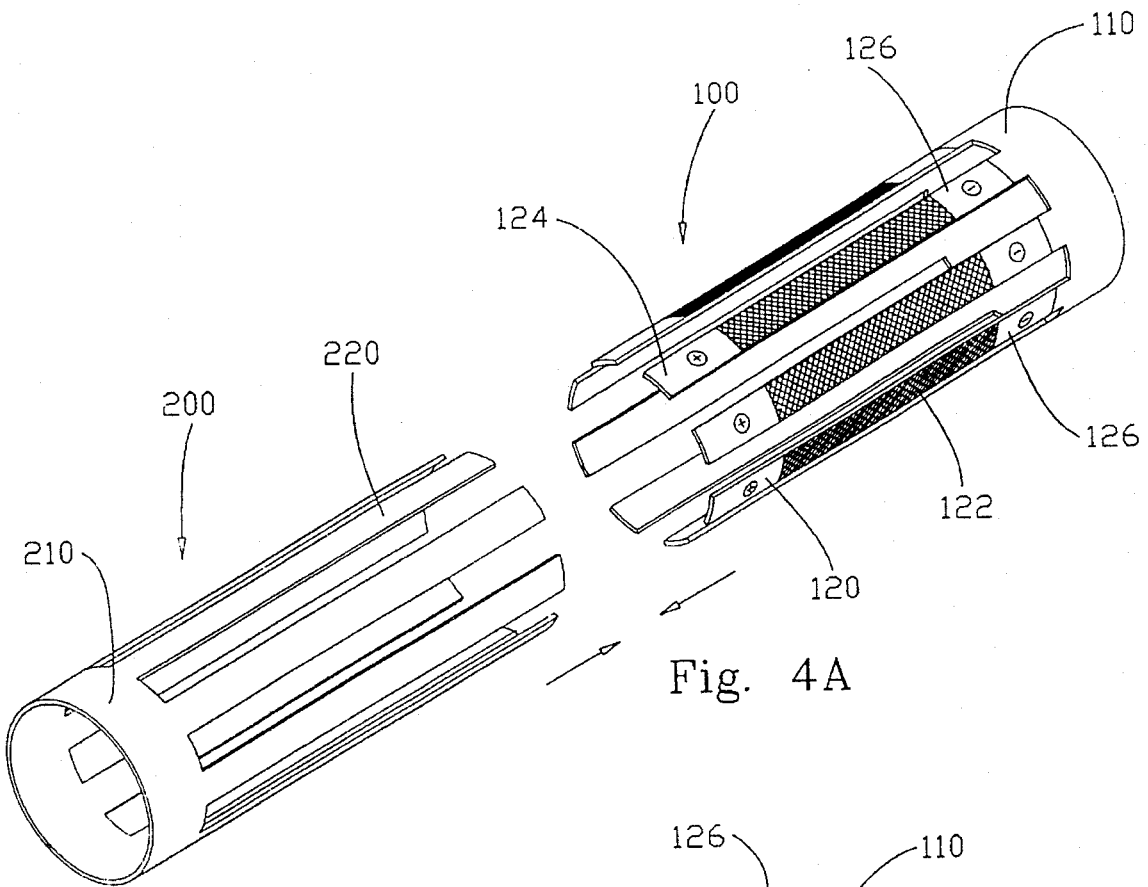
FIG. 4A is a perspective view of a barrier component and a heater component according to an embodiment of the present invention.
Figure 4B:
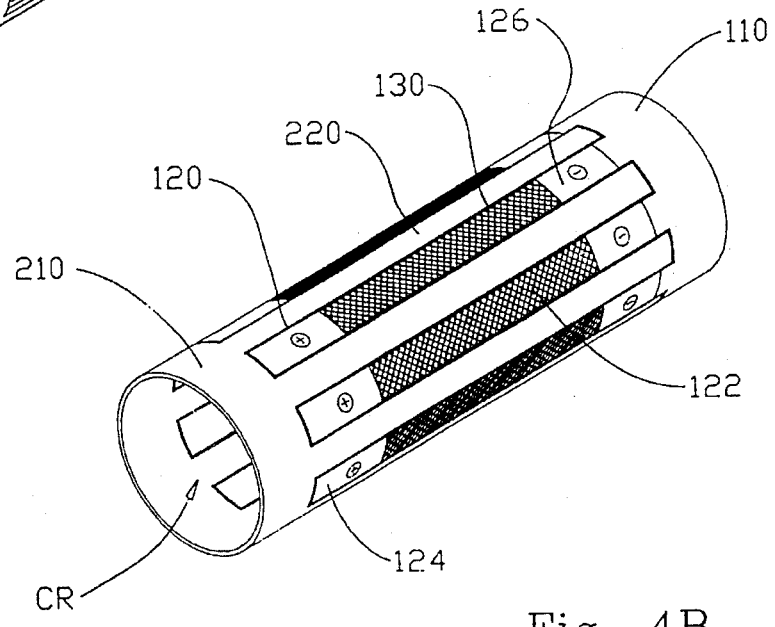
FIG. 4B is a perspective view of the components of FIG. 4A interposed to form a receptacle for an inserted cigarette.

Referring to FIGS. 4A and 4B, a first embodiment is shown comprising a heater component 100 and a barrier component 200. The heater component 100 comprises an end hub 110, which is preferably circular, and a plurality of heater blades 120 extending therefrom in the same direction and having a respective free end. Each heater blade 120 has an associated heater element 122 fixed thereto and preferably approximately 1.5 mm wide. Preferably, heating element 122 is fixed to an outer side of the heater blade 120 to facilitate fabrication as discussed below. Barrier component 200 likewise comprises an end hub 210, which is preferably circular, and a plurality of barrier blades 220 extending in the same direction and having a respective free end.

Preferably, the heater blades 120 are integrally formed with the heater hub 110 and the barrier blades 220 are integrally formed with the barrier hub 210. Such configurations simplify fabrication as discussed below and also increase the mechanical integrity by reducing bond or weld lines.

As shown in FIG. 4B, heater component 100 and barrier component 200 are positioned relative to one another such that a cylindrical or tubular receptacle CR is defined for receiving an inserted cigarette 23. Preferably, there are a number heater blades 120 to provide the desired subjective puffs upon sequential firing of the heating elements 122 to simulate the puff count of a conventional cigarette, and a corresponding number of barrier blades 220.

In a preferred embodiment, there are eight heater blades 120 and correspondingly eight barrier blades 220. Such a configuration assumes that eight separate heaters are desired to generate eight subjective puffs for the cigarette.

It may be desired to change the number of puffs, and hence the number of heating elements 122, achieved when a cigarette is inserted into the cylindrical receptacle CR. This desired number is achieved by forming a desired number of heater blades 120 and associated barrier blades 220. This can be achieved by cutting the tube into equally or unequally sized blades.

If a longer puff is desired than is obtained by a pulsing of a single heater and associated heater blade, then the control logic is configured to fire another heater or additional heater(s) immediately after the pulsing of the initial heater, or during a final portion of the initial pulsing, to heat another segment of the cigarette. The additional heater can be a radially successive heater or another heater. The heater blades should be sized to obtain the total desired number of puffs of a desired duration.

The thickness of the blade and hub substrates is preferably less than or equal to approximately 50 mil, and is more preferably less than or equal to approximately 25 mil, and is most preferably less than or equal to approximately 15 mil. The mass of tube decreases as the thickness decreases, resulting in a lighter unit and decreasing the energy required to adequately heat the heater blades 120 and inserted cigarette, which further reduces the weight of the unit since the power source, e.g., batteries, can be smaller. For example, a 10 mil thick tube as shown in FIG. 4B was constructed as described and was pulsed with approximately 20 and 25 Joules of energy. The heater blade reached temperatures between approximately 800° and 900° C.

The heating element 122 is deposited on the heater blade 120. More specifically, an approximately 0.1 to 5 mil layer of an electrically resistive material such as NiCr alloy, NiCrAIY alloy, FeCrAlY alloy, $FE_3AI$ alloy or $Ni_3AI$ or NiAI alloy is deposited by any known thermal spraying technique such as plasma spraying or HVOF (High Velocity Oxy Fuel). The resistivity of the resistive material may be adjusted with the addition of suitable ceramics or by adjusting the oxidation level of the metal during plasma or HVOF spraying. Thin film techniques, e.g., CVD or PVD, can be used if the surface roughness of the ceramic layer, comprised of relatively large ceramic particles compared to the heater material, is smoothed by, e.g., diamond grinding. With this technique a thinner layer of metal is required, resulting in a desired lower mass heater. However, the process is slower. Any metal with appropriate high temperature oxidation resistance properties such as platinum may be used.

After the electrically resistive heating elements 122 are deposited onto the respective underlying heater blades 120, as discussed, the positive and negative contact pads 124, 126 are deposited. Preferably, these pads have a higher conductivity than the heater element 122 and are described in greater detail in the parent application Ser. No. 08/224,848. Appropriate leads are soldered, welded or brazed, and preferably silver brazed, to the heating elements.

In all the discussed embodiments, the heater blades 120 and hub 110 can alternatively comprise a metal which also serves as a connection for resistive heating element 122 when the hub is connected to the negative connection of the power source 37, as discussed in greater detail in the parent patent application Ser. No. 08/224,848.

The heating elements 122 are each electrically connected via connection elements including contact pads 124 and 126 and the leads to the power source 37. The positive contact pads 124 are electrically connected to one end of resistive heater element 122 and to the positive connection of the power source 37 via the pins 99A and 104A (not shown in the present application) as described in grandparent applications Ser. No. 08/118,665 and parent Ser. No. 8/224,848.

The contact pads 124, 126 having a high electrical conductivity, e.g., of nickel, nickel alloys, copper, or aluminum, are finally sprayed on heater element 120 and leads are then affixed, e.g., by welding, brazing or soldering, to the opposite end, e.g., the proximal end, of the heater element near hub 110. The material can be integrally formed to leads or soldered, and preferably silver soldered, thereto in lieu of connecting pins. The high conductive material of contact pads 124, 126 makes the underlying area less resistive and permits the leads to be more easily added as discussed.

Contact pads 124, 126 are comprised of any appropriate material such as nickel, aluminum or appropriate 50/50 alloys of nickel and aluminum, copper, etc. which are highly conductive and have good adhesion to the resistive material of heating element 122. Contact pads 124 and 126 can be the same material as resistive heating elements 122. Since the hub 110 is a ceramic or another electrical nonconductor, additional contact pads 126 are provided which are electrically connected to the other end of resistive heater element 122, and ultimately to the negative connection of the power source.

Figure 4C:
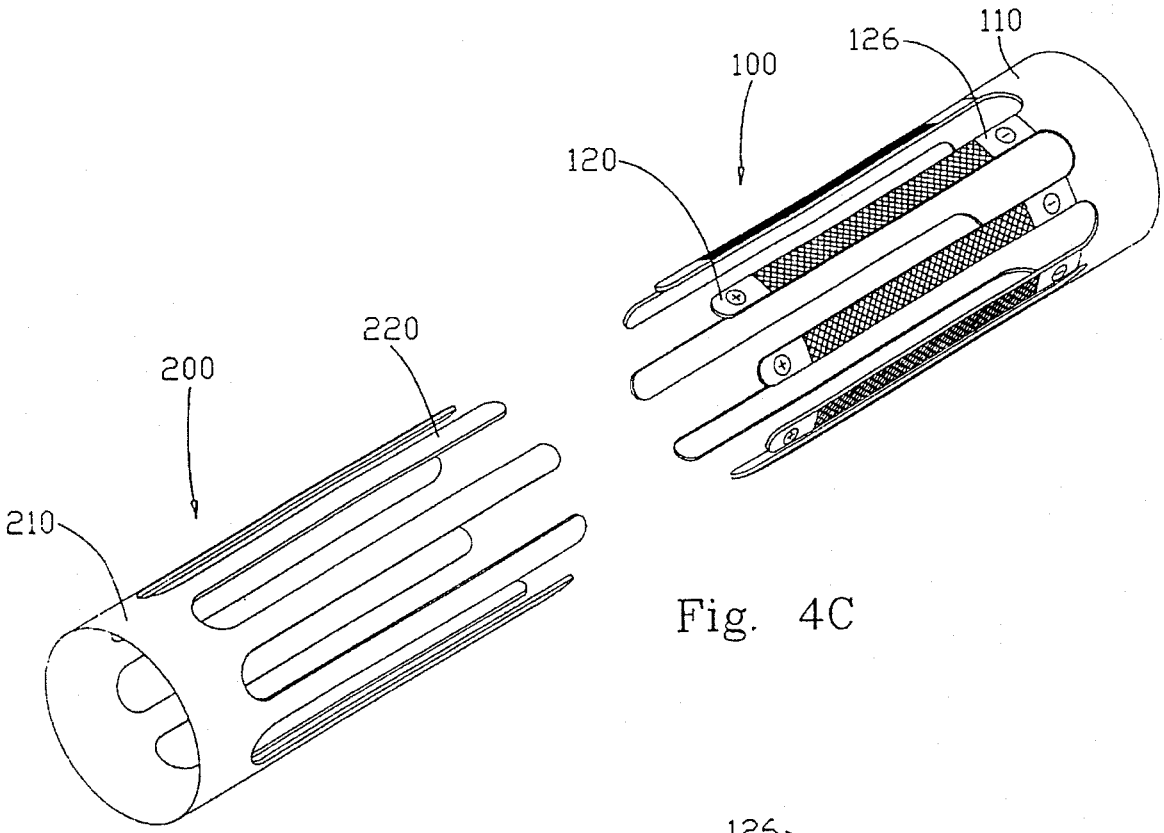
FIG. 4C is a perspective view of a heater component and a barrier component according to another embodiment of the present invention.
Figure 4D:
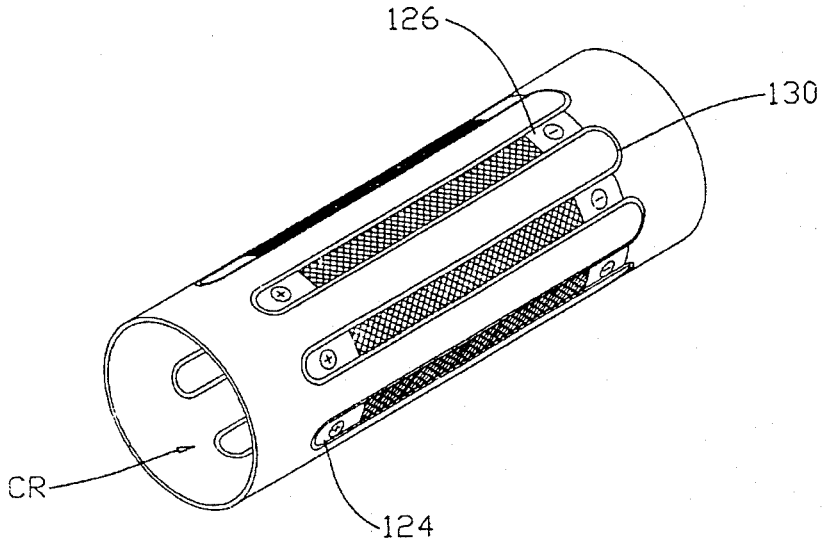
FIG. 4D is a perspective view of the components of FIG. 4C interposed to form a receptacle for an inserted cigarette.

The heater configuration shown in FIGS. 4C and 4D is identical to that shown in FIGS. 4A and 4B except that the heater blades 120 and the barrier blades 220, and consequently gaps 130, are formed in the shape of elongated U's, i.e., the ends are rounded, whereas in FIGS. 4A and 4B the blades and gaps are elongated rectangles, i.e., the ends are squared.

The heaters of FIGS. 4A–D are preferably fabricated by cutting, e.g., via a laser, a tube into two identical pieces, with each piece comprising a hub and associated blades. In one embodiment, the tube is a ceramic such as alumina, zirconia or a mixture of the two. Heating elements 122 and contact pads 124, 126 are deposited via appropriate masks on each piece via any appropriate deposition technique such as thick film, thin film, thermal spray, chemical and physical deposition techniques to form heater blades 120 as discussed.

In a first embodiment, the heating elements are deposited on the surface of a solid ceramic tube which is then cut to form spaced apart blades. Alternatively, in a second embodiment the tube is first cut to form blades 120, 220 and then the heating elements 122 and contact pads 124, 126 are deposited onto the heater blades 120. By employing the first embodiment, it is possible to fabricate two heater components 100 from a single tube. In both embodiments, the tube may be spun while coated with heater material. If desired, the tube is spun during cutting to create the spiralled pattern as shown in the parent application Ser. No. 08/224,848. Likewise, two barrier components 200 are fabricated from a single unlayered tube. Such production efficiencies can be achieved if the formed tubular heater has symmetrical heater blades 120 and barrier blades, i.e., both blades 120, 220 are the same size or are closely sized and the gaps 130 permit interposition. If the blades 120, 220 vary greatly, one tube should be used to fabricate both respective components 100, 200. If desired, the heater component 100 can be formed as discussed in parent application Ser. No. 08/224,848. In the present invention, the heating elements 122 are preferably deposited on the tube rather than onto a sheet which is subsequently rolled into a tube to reduce stresses resulting from rolling. Also, most ceramics do not possess the requisite ductility for rolling. The materials for the heater element and the conducting elements are any appropriate thick film pastes, metals or alloys.

For example, a heater deposited on a 10 mil thick alumina tube was constructed as described and was pulsed with approximately 22 to 23 Joules of energy. The heater blade reached temperatures between approximately 800° and 900° C.

Figure 6:
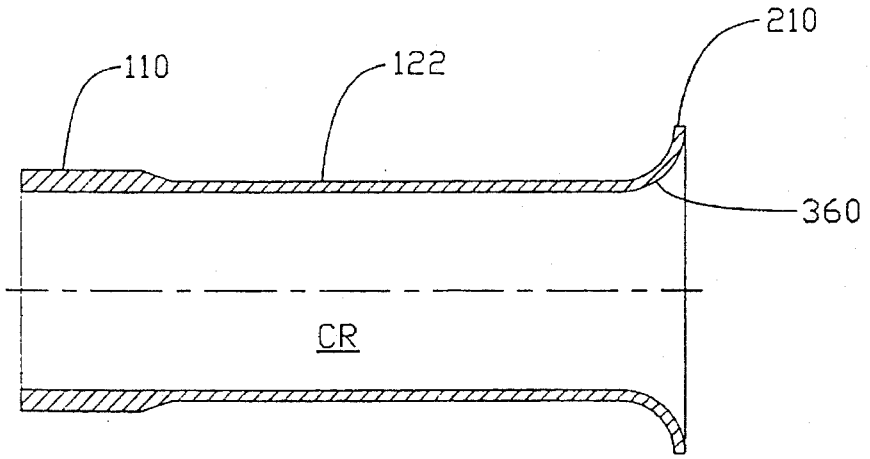
FIG. 6 is a side, cross-sectional view of an embodiment of the present invention.

As shown in FIG. 6, the tube preferably defines a flared distal end 360 and hub 110 and a narrower, or relatively constricted, waist section which defines the cylindrical receptacle CR. Slots are formed through the tube to define thermally and electrically insulating gaps 130, 135. These slots define the blades 120, 220 and are preferably formed from the transition area between the insertion end hub 210 and the middle section defining the receptacle CR to the hub 110. The gaps should extend a short distance beyond to applied heating layer 120 at hub 210 and also a short distance into hub 110 beyond the applied heating element 120. This extension distance should not be long enough to significantly weaken the hubs, e.g., approximately 0.5 mm. is sufficient.

The gaps can alternatively be cut by rotating the ceramic tube relative to a laser. Longitudinally extending slots are cut by relatively translating the laser and tube with respect to the longitudinal axis of the tube. Spiral slots are cut by rotating the tube relative to the laser and translating the laser and tube relatively with respect to the tube longitudinal axis. In addition to avoiding, or more specifically reducing contact with, the cigarette glue line, spiral slots formed by rotation possibly facilitate an in-line fabrication if the tube is also rotated relative to a fixed laser.

The embodiment of FIG. 6 comprises a tube having hubs 110 and 210 which have a larger diameter than the cylindrical receptacle CR defined by alternating heater blades 120 and barrier blades 220, i.e., the cylindrical receptacle CR is constricted or relatively inwardly located, to provide a compressive force on the inserted cigarette. Accordingly, physical contact between the heater blade 120 and the inserted cigarette is increased, thereby increasing the heat transfer therebetween. Since the tube is ceramic, this constructed shape is preferably achieved by molding, i.e., forming a green structure have the desired geometric shape and firing rather than extruding as with metal tubes.

The ceramic substrate 121 is thus fabricated such that it preferably has a generally tubular or cylindrical shape. As best seen in FIG. 6, a tube is provided having a generally circular open insertion end having a narrowing throat 360 which directs the inserted cigarette toward the coaxially defined cylindrical receptacle CR having a diameter which is less than the insertion end. The insertion end preferably has a diameter which is greater than the inserted cigarette 23 to guide the cigarette towards the receptacle CR, and the receptacle CR has a diameter approximately equal to cigarette 23 to ensure a snug fit for a good transfer of thermal energy. Given acceptable manufacturing tolerances for cigarette 23, a gradually narrowing area or throat 360 in the transition between the distal end and the receptacle CR can also serve to slightly compress the cigarette to increase the thermal contact with the surrounding heating blade 120 serving as a inner wall of the receptacle. The opposite end of the tube defines terminal hub 110 having any appropriate diameter.

The various embodiments of the present invention are all designed to allow delivery of an effective amount of flavored tobacco response to the smoker under standard conditions of use. Particularly, it is presently understood to be desirable to deliver between 5 and 13 mg, preferably between 7 and 10 mg, of aerosol to a smoker for 8 puffs, each puff being a 35 ml puff having a two-second duration. It has been found that, in order to achieve such delivery, the heater blades 120 should be able to reach a temperature of between about 200° C. and about 900° C. when in a thermal transfer relationship with the cigarette 23. Further, the heater blades 120 should preferably consume between about 5 and about 50 Joules of energy, more preferably between about 10 Joules and about 25 Joules, and even more preferably between about 15 to 20 Joules.

Heating blades 120 having desired characteristics preferably have an active surface area of between about 3 $mm^2$ and about 25 $mm^2$ and preferably have a resistance of between about 0.5 Ω and about 3.0 Ω. More preferably, the heating elements 122 should have a resistance of between about 0.8 Ω and about 2.1 Ω. Of course, the heater resistance is also dictated by the particular power source 37 that is used to provide the necessary electrical energy to heat the heating elements 122. For example, the above heater element resistances correspond to embodiments where power is supplied by four nickel-cadmium battery cells connected in series with a total non-loaded power source voltage of approximately 4.8 to 5.8 volts. In the alternative, if six or eight such series-connected batteries are used, the heating elements 122 should preferably have a resistance of between about 3 Ω and about 5 Ω or between about 5 Ω and about 7 Ω, respectively.

As discussed, it is preferred to deposit the heating elements 122 onto the outer surface of the heater blade 120, i.e., the blade surface opposite the surface contacting or in thermal proximity to the inserted cigarette 23, to simplify fabrication. Also, by depositing the heating elements 122 on this outer surface, a relatively robust support is formed for the heater elements and the heater elements avoid direct forceful interaction with the cigarette during insertion, any interim adjustments and removal by the smoker. Such an advantageous mechanical configuration requires that the heating element 122 heat the underlying ceramic layer of the heater blade 120 and contacting the inserted cigarette to transfer heat primarily via conduction to the inserted cigarette and secondarily via convection and radiation if a snug interface is not maintained between the pulsed heater blade 120 and the inserted cigarette. Preferably, the heating element 122 is sized and thermally designed to heat the majority of the underlying heater blade 120 to ultimately heat a segment of the inserted cigarette having sufficient size, e.g., 18 square mm, to generate an acceptable puff to the smoker. The heat transfer from the heating element 122 to the cigarette 23 should not suffer significant inefficiencies since the heater supplies a pulse of heat energy through relatively thin ceramic layer. The heating element 122 itself, depending on the material selected and the deposition technique, is between approximately 1 and 2 mils thick. The heater element is previously mentioned MCrAIY alloy, FeCrAIY, NiCrAIY or Nichrome® brand alloys (54–80% nickel, 10–20% chromium, 7–27% iron, 0–11% copper, 0–5% manganese, 0.3–4.6% silicon, and sometimes 1% molybdenum, and 0.25% titanium; Nichrome I is stated to contain 60% nickel, 25% iron, 11% chromium, and 2% manganese; Nichrome II, 75% nickel, 22% iron, 11% chromium, and 2% manganese; and Nichrome III, a heat-resisting alloy containing 85% nickel and 15% chromium) or aluminides of nickel and iron. The ceramic layer having relatively moderate to low thermal conductivity will not conduct significant amounts of heat to its associated hub, e.g. not greater than between approximately 5 and 10%, because of short pulse time and small cross-section.

The materials of which the heating elements 122 are made are preferably chosen to ensure reliable repeated uses of at least 1800 on/off cycles without failure. The heater fixture 39 is preferably disposable separately from the lighter 25 including the power source 37 and the circuitry, which is preferably disposed of after 3600 cycles, or more. The heating element materials are also chosen based on their oxidation resistance and general lack of reactivities to ensure that they do not oxidize or otherwise react with the cigarette 23 at any temperature likely to be encountered. If desired, the heating elements 122 are encapsulated in an inert heat-conducting material such as a suitable ceramic material to further avoid oxidation and reaction.

Based on these criteria, materials for the electric heating elements include doped semiconductors (e.g., silicon), carbon, graphite, stainless steel, tantalum, metal ceramic matrices, and metal alloys, such as, for example, nickel and iron-containing alloys.

Suitable metal-ceramic matrices include silicon carbide aluminum and silicon carbide titanium. Oxidation resistant intermetallic compounds, such as nickel aluminum, aluminides of nickel and aluminides of iron, are also suitable.

More preferably, however, the electric heating elements 122 are made from a heat-resistant alloy that exhibits a combination of high mechanical strength and resistance to surface degradation at high temperatures. Preferably, the heating elements 122 are made from a material that exhibits high strength and surface stability at temperatures up to about 80 percent of their melting points. Such alloys include those commonly referred to as super-alloys and are generally based on nickel, iron, or cobalt. For example, alloys of primarily iron or nickel with chromium, aluminum, and yttrium are suitable. Preferably, the super alloy of the heating elements 122 includes aluminum to further improve the performance of the heater element, e.g., by providing oxidation resistance. In the serpentine-shaped heater discussed below, a preferred alloy is available from Haynes International, Inc. of Kokomo, Ind., under the name Haynes® 214™ alloy. This high-temperature material contains, among other elements, about 75% nickel, about 16% chromium, about 4.5% aluminum and about 3% iron by weight.

Once the heater component 100 is formed, it is interposed, and specifically interlocked, with barrier component 200 to form the cylindrical receptacle CR for the inserted cigarette 23. As discussed, gaps 130 are defined between each adjacent heater blade 120 and barrier blade 220. These gaps can be formed by slightly cutting or shaving one or both set(s) of the barrier or heater blades prior to interposing. The gaps 130 are sized to be large or wide enough to prevent heat loss during pulsing from a heated heater blade to adjacent barrier blades and to permit a desired transverse air flow, and small or narrow enough to prevent significant amounts of vapor from escaping cylindrical receptacle. For example, a gap of approximately 5–15 mil or less, and preferably approximately 5 mil, is appropriate in many applications.

Figure 5:
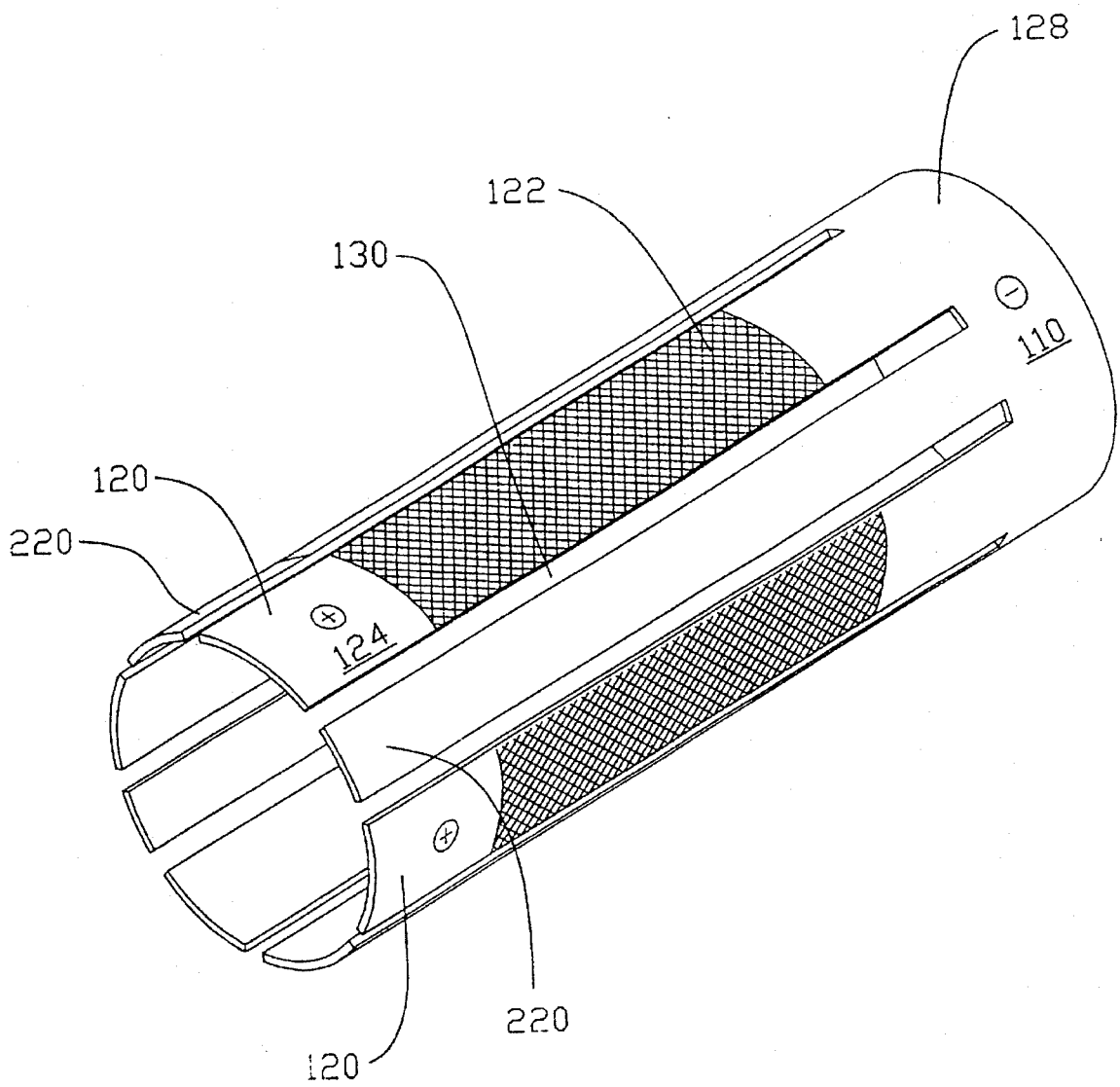
FIG. 5 is a perspective view of a heater according to another embodiment of the present invention having a single hub and a plurality of alternating heater blades and differently sized barrier blades.

The relative widths of the heater blades 120 and the barrier blades 220 are dictated by the contact pads between the heater blade 120 and the underlying inserted cigarette required to generate an acceptable puff. The relative widths of the heater and barrier blades need not be equal. As shown in the embodiment of FIG. 5, the width of the barrier blade 220 is less than that of the heater blade 120. In addition, more than eight heater blades 120 can be employed to generate additional puffs from the inserted cigarette, e.g., any number of heaters and corresponding heater blades can be employed, limited only by the puff generating capacity of the cigarette. A balanced number of barrier blades 220 is preferably employed if barrier blades are used.

After a heater element 122 is pulsed via puff actuation, there is a predetermined minimum time before a subsequent puff is permitted. During this predetermined or longer puff interval, the two barrier blades 220 adjacent, i.e., on either side of, the recently pulsed heater element 122, and the associated heater blade 120 act as heat sinks to prevent heat from propagating to other heater blades 120 or to unheated or previously heated portions of the inserted cigarette 23. Premature heating of a portion of the cigarette could result in undesired aerosol generation or heat-induced degradation of the cigarette portion prior to the desired heating. Subsequent reheating of a previously heated portion can result in undesired flavors and tastes being evolved. To achieve this heat sink function, the barrier blades preferably comprise thermally nonconductive material, i.e., a thermal insulator, such as a ceramic. Examples of suitable ceramics include alumina, zirconia or a mixture thereof having a higher conductivity and a higher strength than the individual alumina or zirconia.

The individual positive electrical connection for each of the heating elements 122 is preferably provided via contact pads 124 as discussed. The individual negative electrical connection is similarly provided via contact pads 126 as discussed with reference to FIGS. 4A–4D. Alternatively, a common negative electrical connection is provided by a ring of contact material overlying an end hub and electrically contacting the end of heating element 122 opposite positive contact pad 124. This connection can be employed in the embodiments of FIGS. 4A–4D. Further, as indicated by the encircled minus sign in FIG. 5, contact material 128 is applied to an end of blade 120 opposite positive contact pad 124 and, if desired, to hub 110 to form a common. The contact material can optionally be applied to barrier blade 220. Similarly, contact material 128 is applied to the hub 110 and each of the heater blades opposite contact pad 124 of the embodiment of FIG. 7. Referring to the embodiments of FIGS. 8A and 8B, contact material 128 is applied over hub 110 and electrically contacts the heating element 122 opposite contact pad 124. Contact material 128 is optionally applied to the ceramic barrier blade 220 integrally formed between hubs 110 and 210 as well as optionally applied to hub 210. In each of the embodiments, the contact material 128 formed around the hub forms an electrical common in the form of a ring for all of the connected heating elements. The common is formed via masking, as discussed with reference to the contact pads. If at least one of the barrier blades 220 are coated with contact material, the blade 220 can function as conducting paths and the coated hub 210 can serve as the common ring.

In another embodiment, wherein the final heater is shown in FIG. 5, a ceramic tube is cut to define a single hub 110 having a plurality of, e.g., sixteen, blades with respective gaps 130 therebetween. Note that a total of eight blades is shown. Alternate blades are deposited with heater elements 122 as described above to define heater blades 120, whereas the other interposed blades define the barrier blades 220. Alternatively, the tube is cut to provide two oppositely located hubs 110 and 210, e.g., the laser is directed to cut rectangular wave patterns through the tube, as shown in FIGS. 8A and 8B. Such a construction increases the mechanical integrity of the heater blades 120 and barrier blades 220 by providing a supporting hub 220 at the point of insertion of the cigarette into the defined receptacle. In a further alternative embodiment, all of the blades are coated to form heater blades such that, e.g., sixteen heater blades are formed that can be pulsed alternatively for successive cigarettes, as discussed with reference to FIG. 7. By forming the hub(s) and the respective heater and barrier blades as an integral, monolithic structure, significantly improved mechanical and thermal integrity is provided since the number of stress points, thermal sinks, etc., arising from employing various materials is reduced. Also, fabrication is simplified as the number of steps is reduced.

Figure 7:
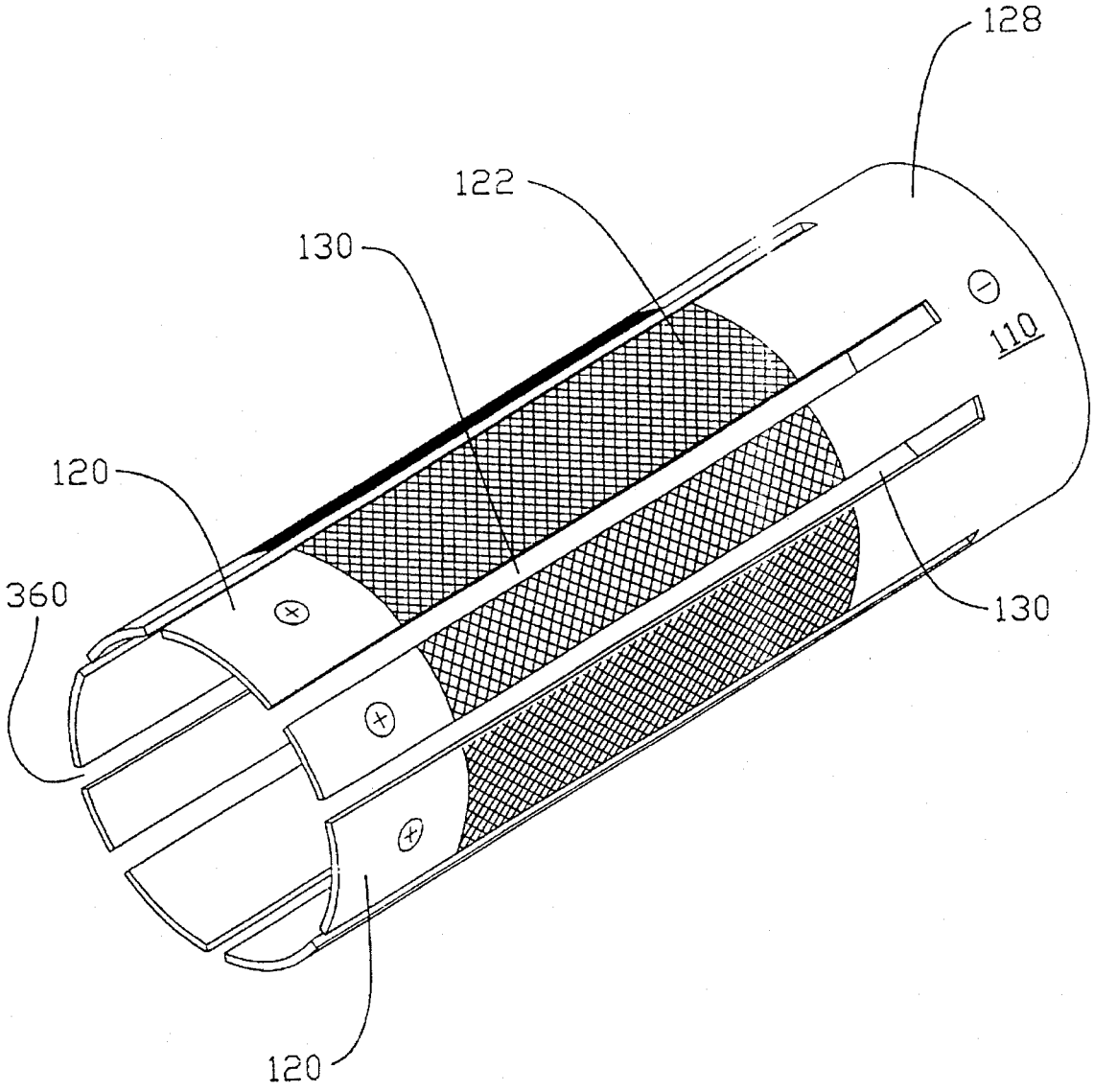
FIG. 7 is a perspective view of an embodiment of the present invention employing a plurality of heater blades extending from a single hub.
Figure 8A:
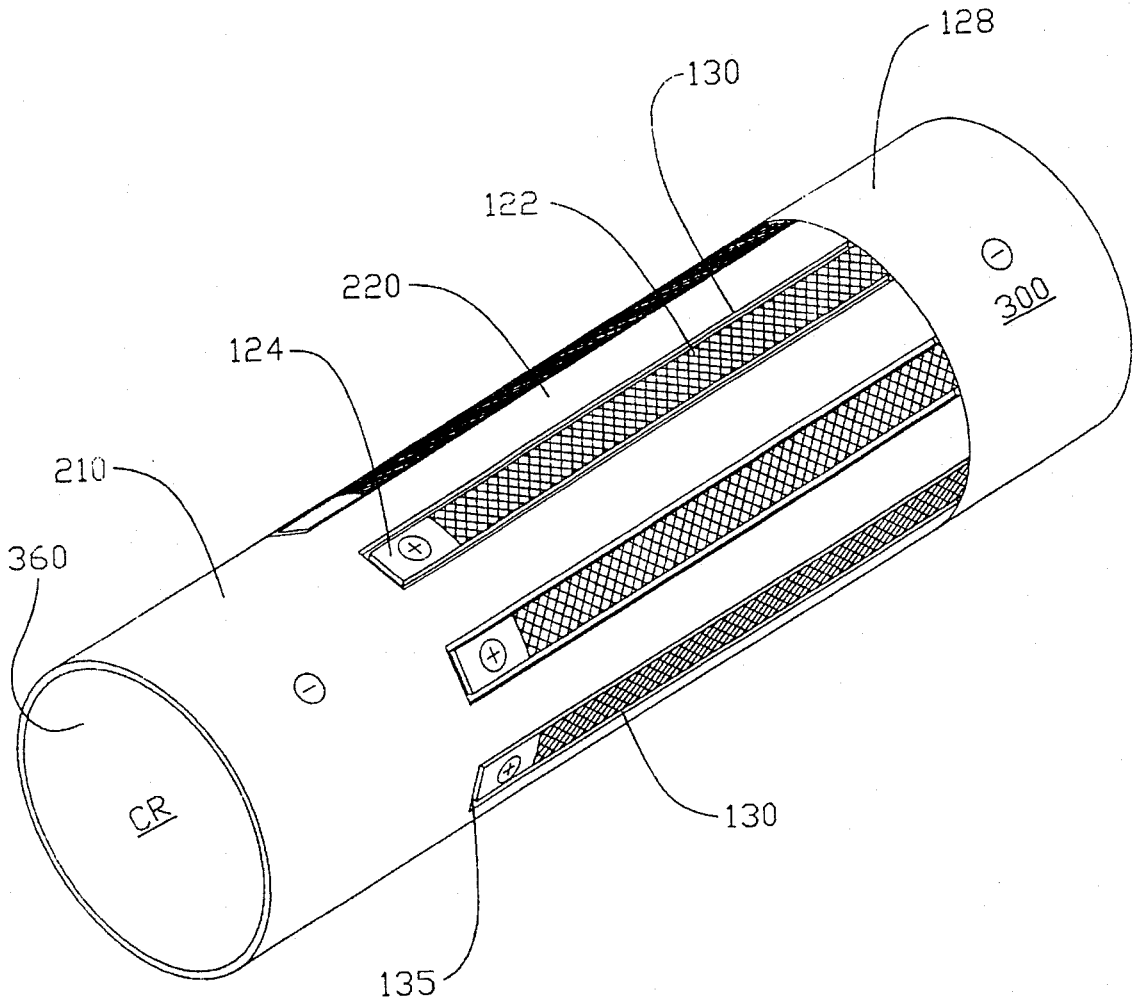
FIGS. 8A and 8B are perspective views of an monolithic embodiment having rectangular and rounded gaps and two end hubs.
Figure 8B:
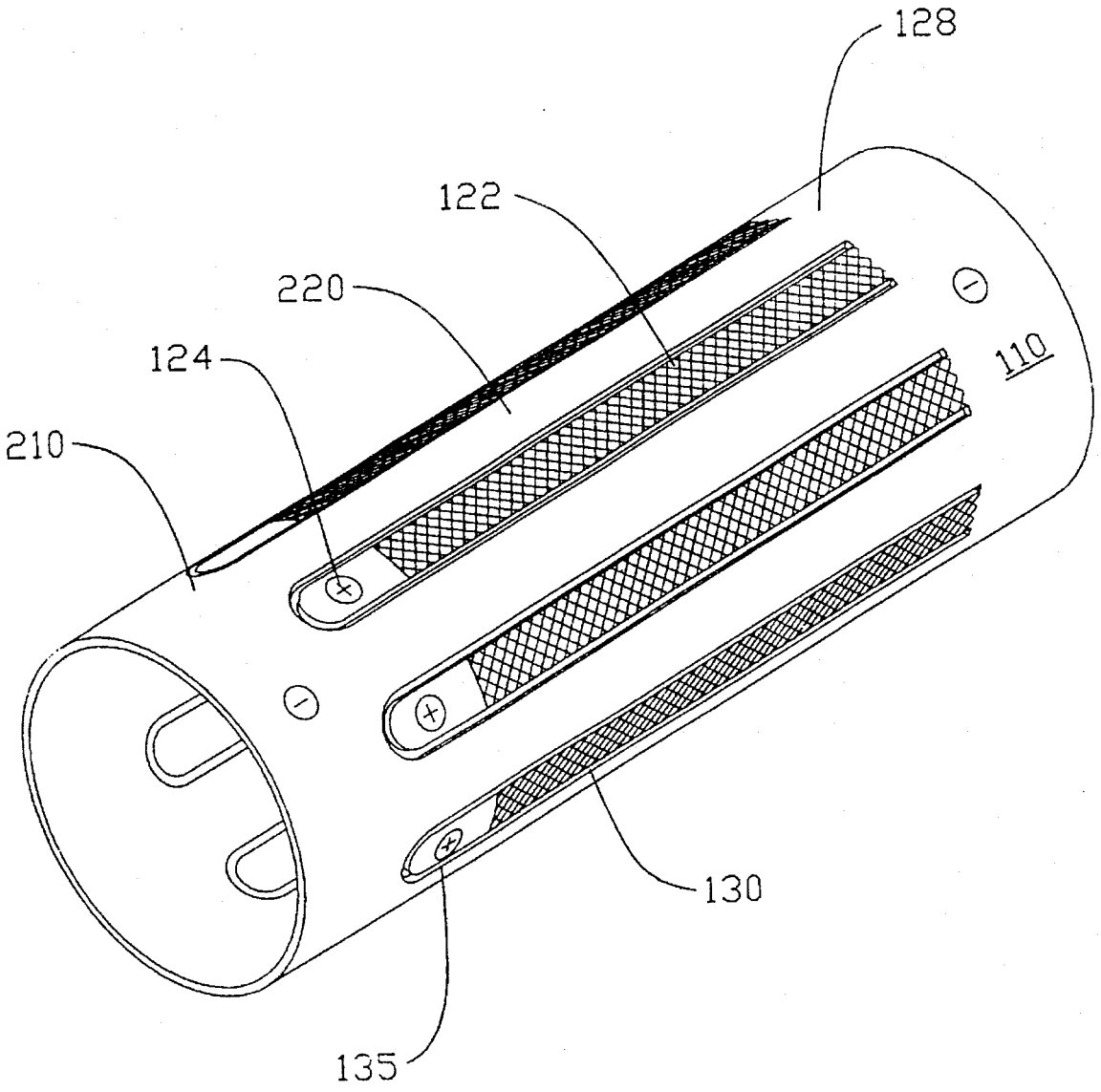

As shown in FIG. 7, all of the areas bounded by gaps can function as heater blades 120. In one embodiment, each ceramic coated portion or blade has a heating element 122 deposited thereon and the number of heater blades 120 corresponds to the number of desired puffs, e.g., eight. In another embodiment, each ceramic coated portion has a heating element 122 and the number of formed heater blades 120 is twice the number of puffs, e.g., there are sixteen portions with heaters for an eight puff cigarette. Such a configuration permits different firing sequences than the normal successive firing of approximately 2 seconds, and preferably the radially sequential firing sequence for an embodiment wherein the number of heating elements 122 corresponds to the puff count. For example, the logic circuit can dictate that two circumferentially opposite heater elements 122, i.e., heating elements separated 180° on the tube, fire simultaneously to jointly heat an adequate amount of the cigarette to generate a puff. Alternatively, a first firing sequence of every other heater element 122 for a cigarette is followed by a second firing sequence of the intervening heater elements 122 for the next cigarette. Alternatively, this first firing sequence can be repeated for a predetermined life cycle of numerous cigarettes and then the second firing sequence initiated. When a heater blade is not participating in a selected firing sequence, this blade functions in effect as a barrier blade.

Figure 9:
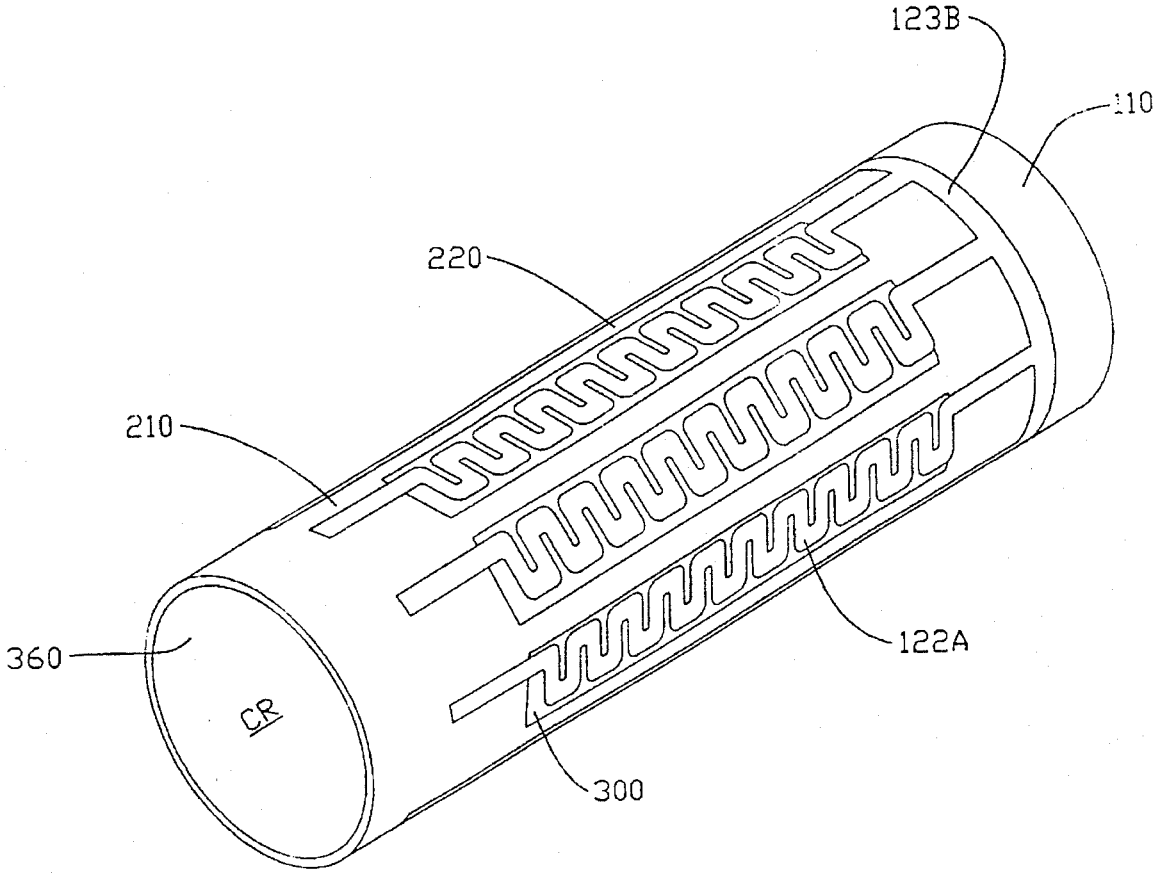
FIG. 9 is a perspective view of an embodiment of the present invention wherein slots are defined for insulated heaters.
Figure 10:
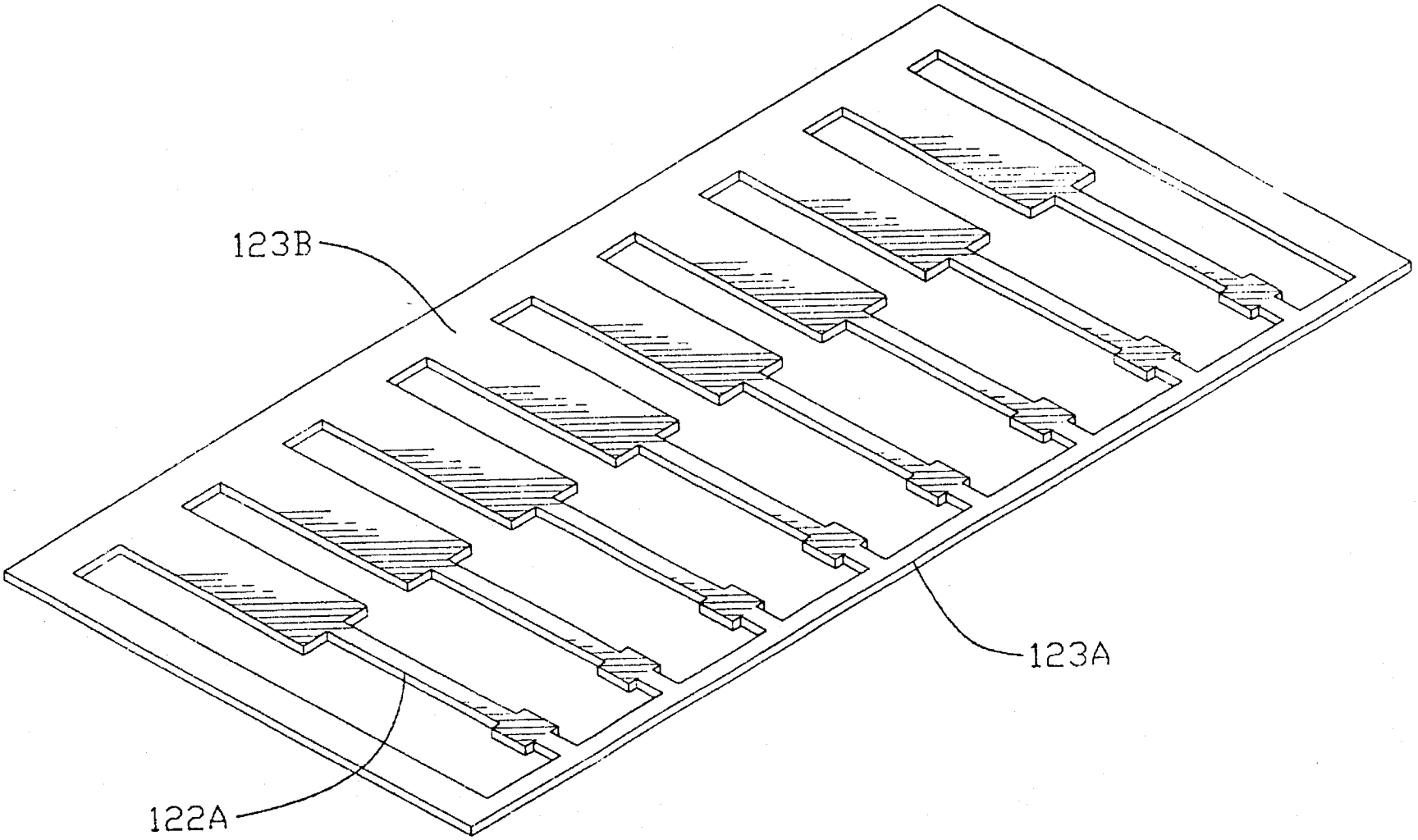
FIG. 10 is a perspective view of a heater cutout prior to rolling.
Figure 11:
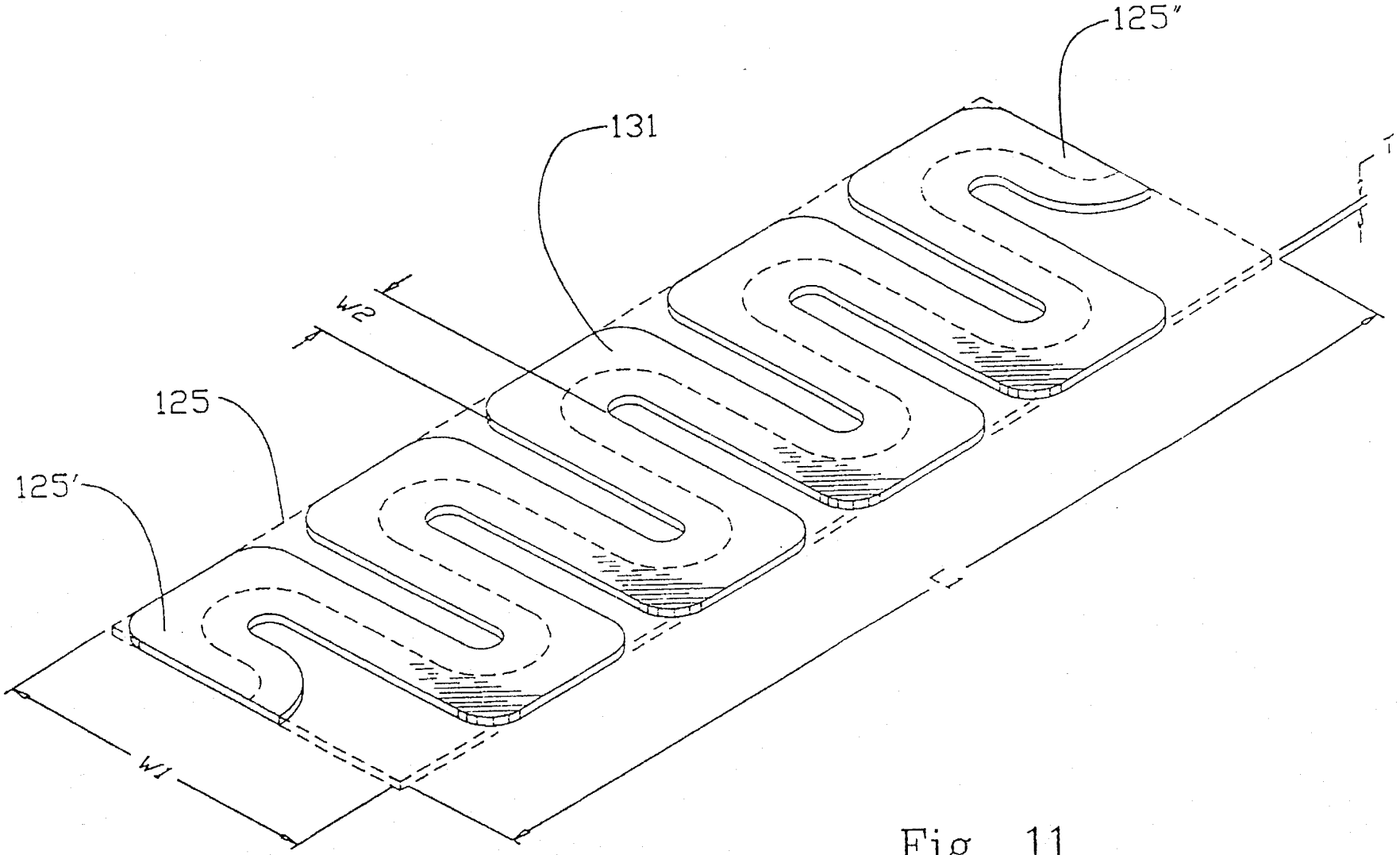
FIG. 11 is an elevational view of a serpentine-shaped heater element according to the present invention which is inserted into the slots of FIG. 9.

A further embodiment of the present invention is shown in FIGS. 9–11. The ceramic tube comprises two hubs 110 and 210 located at opposite ends of the cylinder and interconnected by a plurality, e.g., eight, barrier blades 220, as shown in FIG. 9. Preferably the hubs 110 and 210 and barrier blades 220 are integrally formed from a ceramic tube by cutting, e.g., via a laser, longitudinally extending spaces or slots 300 from the tube. Each space is defined longitudinally by a respective opposing edge of two successive barrier blades and laterally by end hubs 110 and 210. Each cut space is wide enough to receive an inserted heating element 122A and to provide a gap having the dimensions described above between the inserted heater element and the formed heater blades. The length of the cut space should be slightly less than the length of a planar heating element 122A or slightly less than the linear distance between opposite ends of the heating element which is inwardly bowed prior to insertion. This permits the heating element 122A to be slightly compressed for insertion into the space and to then be snugly fitted into the space with an inward bowing as it attempts to return to its initial state prior to bending. Thus, the inserted heating element 122A presses against, and is supported by, opposite hub walls. A common hub 123B is provided which is joined to heating elements 122A. In this embodiment, radial flow is achieved via spacings around the inserted heater element 122A and can be supplemented via perforations in the barrier blades as discussed above. Appropriate gaps 130 are defined as discussed between inserted heater elements and adjacent barrier blades. The heating element is made by any known technique, e.g., thermal spray, thick or thin film spray, and is preferably serpentine-shaped as discussed below. Alternatively, a rectangular foil heater or a thermally sprayed heater is employed.

This embodiment offers the advantage of reduced weight since a significant portion of the tube is removed to form the slots for the inserted heating elements having no ceramic backing. Also, the heating elements can be an even lower mass serpentine shape as discussed below. In addition, improved propagation of heat from the heating element 122A to the cigarette is achieved since direct contact is obtained by inward bowing or pre-insertion biasing of the heating element 122A.

Rather than inserting individual heating elements 122A into the provided spacings, a stamped, punched or laser cut outline is provided as shown in FIG. 10 which defines a plurality, e.g., eight, heating elements 122A spaced apart from one another and having two connecting segments, namely, a first connecting segment 123A integrally formed with a first end of each heating element 122B and a second connecting segment 123B integrally formed with an opposite second of each heating element 122B. This outline is then rolled around the tube of FIG. 9 and segment 123A removed such that the connecting segment 123B forms a common hub which overlies, and is connected to, hub 110, and the heater elements each lie in a respective spacing with an appropriate gap. Preferably, the heating elements 122B are biased inwardly prior to rolling.

One of the rounded connecting segments, e.g., segment 123B, can serve as a common negative hub for the inserted heating element 122B which is electrically connected to the negative of the power source via a bonded lead. The other connecting segment, e.g, segment 123A, is cut after stamping so as to electrically isolate the respective opposite ends of the heating elements 122B. Positive connections are then made by, e.g., laser welding leads to these opposite ends.

As noted above, the individual heating elements 122 of the heater assembly preferably include a "footprint" portion 131 having a plurality of interconnected curved regions—substantially S-shaped—to increase the effective resistance of each heater element, as shown in FIG. 11. Any of the heating elements 122 or 122A can have this geometric configuration. The serpentine shape of the footprint 131 of the heating elements 122 provide for increased electrical resistance without having to increase the overall length or decrease the cross-sectional width of the heater element. Heating elements 122 having a resistance in the range from about 0.5 Ω to about 3 Ω and having a foot-print length L1 comprising preferably N interconnected S-shaped regions, wherein N is in the range from about three to about twelve, preferably, from about six to about ten.

If the heater footprint 131 shown in FIG. 11 is first cut into the shape of the wide portion 125 shown by dotted outlines such that the side portion has a width W1, length L1, and thickness T, the resistance R, from one end 125' to the opposite end 125" of the wide portion is represented by the equation:

$$R = \frac{p(L1)}{W1(T)}$$

where ρ is the resistivity of the particular material being used. After forming the footprint 131, the resistance of the footprint is increased since the effective electrical length of the resistance heating element 122 is increased and the cross-sectional area is decreased. For example after the footprint is formed in the heating element 122, the current path through the heating element is along a path P. The path P has an effective electrical length of approximately 9 or 10·W1 (for the nearly five complete turns of the footprint of the heating element), which is greater than the initial electrical length of L1. Furthermore, the cross-sectional area has decreased from W1·T to W2·T, where W2 is less than W1. In accordance with the present invention, both the increase in electrical length and decrease in cross-sectional area have a tendency to increase the overall electrical resistance of the heating element 122, as the electrical resistance is proportional to electrical length and inversely proportional to cross-sectional area.

Thus, forming the footprint 131 in the heating element 122 allows a smaller volume of conducting material to be used to provide a given predetermined resistance over a given heated surface area, e.g. 3 $mm^2$ to 25 $mm^2$. This feature of the present invention provides at least three benefits.

First, for a given resistance, the heating element 122 is formed from a rectangular sheet having a length that, if formed as a linear element, would have to be longer. This allows for more compact heater fixture and lighter 25 to be manufactured at a lower cost.

Second, because the energy required to heat a heating element 122 to a given operating temperature in still air increases as the mass of the heater element increases, the serpentine heating element is energy-efficient in that it provides a given resistance at reduced volumes. For example, if the volume of a heating element 122 is reduced by a factor of two, the mass is also reduced by the same factor. Thus, since the energy required to heat a heating element 122 to a given operating temperature in still air is substantially proportional to the mass and heat capacity of the heater element, reducing the volume by a factor of two also reduces the required energy by approximately a factor of two. This results in a more energy-efficient heating element 122.

A third benefit of the reduced volume of the serpentine heating element 122 is related to the time response of the heating element. The time response is defined as the length of time it takes a given heating element 122 to change from a first temperature to a second, higher temperature in response to a given energy input. Because the time response of a heating element 122 is generally substantially proportional to its mass, it is desirable that a heater element with a reduced volume also have a reduced time response. Thus, the serpentine heating elements 122, in addition to being compact and energy-efficient, are also able to be heated to operating temperatures quicker. This feature of the present invention also results in a more efficient heating element 122.

Thus, by providing a plurality of turns in the heating elements 122, e.g., in the shape of a serpentine pattern, the resistance of the heater element is increased without the need to increase the length or decrease the cross-sectional area of the heater element. Of course, patterns other than that of the heater element 43 shown in FIG. 8 are available to employ the principles embodied in that configuration and thereby also provide a compact and efficient heater element.

The footprint 131 is cut into the heating elements 122 by any compatible method, preferably by a laser (preferably a $CO_2$ laser). Because of the geometries used in the serpentine heating element 122 (for example, gap between each "wave" in FIG. 11 is preferably on the order of from about 0.1 mm to about 0.25 mm) laser cutting is preferable over other methods for cutting the footprint 131. Because laser energy is adapted to be concentrated into small volumes, laser energy facilitates versatile, fast, accurate and automated processing. Furthermore, laser processing reduces both the induced stress on the material being cut and the extent of heat-affected material, i.e., oxidized material in comparison to other methods of cutting, e.g., electrical discharge machining. Other compatible methods include electrical discharge machining, precision stamping, chemical etching, and chemical milling processes. It is also possible to form the footprint portion 131 with conventional die stamping methods, however, it is understood that die wear makes this alternative less attractive, at least for serpentine designs. This construction is further discussed in grandparent application Ser. No. 08/118,665.

It has been found that a primarily transverse or radial air flow relative to the inserted cigarette results in a more desirable smoke generation than a primarily longitudinal flow. The gaps 130, 130A provide pathways for air to be drawn into contact with the inserted cigarettes. Additional air passages are provided to optimize the transverse air flow by perforating sections of the heater blade not overlaid with heater elements and/or perforating the barrier blades. Perforation is preferably achieved by a laser after applying the heating elements 122 or by a mechanical perforator before application. To avoid patterning and perforating the heater blade prior to depositing the heater elements or perforating the heater blades after deposition, the barrier blades can be exclusively perforated if adequate air flow is achieved in conjunction with the gaps.

As discussed above, gaps 130 are provided to avoid heating adjacent blades and to define pathways for transverse air flow. In addition, these gaps permit for thermal expansion and contraction of the heater blades 120 and barriers blades 220. In the previously discussed embodiments employing a single hub, the gaps 130 are defined between the longitudinal sides of adjacent blades to compensate for temperature induced latitudinal changes. Longitudinal changes are permitted since the ends of the blades opposite the single hub are free. In the previously discussed dual hub embodiments, the gaps 130 are defined by an elongated, rectangular wave to provide gaps between longitudinal sides of adjacent blades and between the rounded or squared free blade ends and the opposing hub.

Many modifications, substitutions and improvements may be apparent to the skilled artisan without departing from the spirit and scope of the present invention as described and defined herein and in the following claims.

What is claimed is:

1. A heater for use in a smoking article having a source of electrical energy for heating a cigarette, said heater comprising:

a plurality of heater elements electrically connected to the source of electrical energy to be heated thereby; and a plurality of barrier blades;

wherein said plurality of heater elements and said plurality of barrier blades are located adjacent one another in a thermally isolated alternating and interdigitated arrangement and define a cylindrical receptacle to receive the cigarette upon insertion for heating by said plurality of heater elements, said plurality of barrier blades reducing escape from the defined cylindrical receptacle of vapors generated by said plurality of heater elements heating selected portions of the cigarette.

2. The heater according to claim 1, further comprising a plurality of heater blades, each heater blade having a respective heater element fixed thereto.

3. The heater according to claim 2, wherein said plurality of heater elements are each respectively located on an outer side of a respective heater blade opposite an inner side of the heater blade facing the inserted cigarette.

4. The heater according to claim 2, wherein there are eight heater blades and eight barrier blades.

5. The heater according to claim 2, wherein said barrier blades comprise a thermally insulating material.

6. The heater according to claim 2, further comprising a supporting hub, each of said plurality of said heater blades extending longitudinally from said supporting hub in a particular same direction.

7. The heater according to claim 6, wherein each of the plurality of said barrier blades extend longitudinally from said supporting hub in the particular direction.

8. The heater according to claim 2, wherein said plurality of heating of heater blades and said barrier blades are arranged to define a longitudinally extending gap between each adjacent barrier blade and heater element.

9. The heater according to claim 8, wherein the defined gaps are less than or equal to approximately 15 mil. wide.

10. The heater according to claim 8, wherein the defined gaps are approximately 5 mil. wide.

11. The heater according to claim 8, wherein the defined gaps are approximately 5 mil, wide.

12. The heater according to claim 1, wherein there are eight heater elements and eight barrier blades.

13. The heater according to claim 1, wherein said barrier blades comprise a thermally insulating material.

14. The heater according to claim 1, further comprising a supporting hub, each of said plurality of barrier blades extending longitudinally from said supporting hub in a particular direction.

15. The heater according to claim 1, wherein said plurality of heater elements and said plurality of barrier blades are arranged to define a longitudinally extending gap between each adjacent blade and heater element.

16. The heater according to claim 15, wherein the defined gaps are less than or equal to approximately 15 mil. wide.

17. The heater according to claim 15, wherein the defined gaps are approximately 15-5 mil. wide.

18. The heater according to claim 15, wherein the defined gaps are approximately 5 mil. wide.

19. The heater according to claim 2, wherein said heater blades comprise an electrically insulating substrate, and said heater element comprises an electrically resistive layer deposited on the electrically insulating substrate, said electrically resistive layer electrically connected to the source of electrical energy and heated thereby.

20. The heater according to claim 19, wherein said substrate faces the inserted cylindrical cigarette.

21. The heater according to claim 19, further comprising a heater blade hub connected to a respective end of each of the plurality of said heater blades and further comprising a barrier blade hub connected to a respective end of each of the plurality of said barrier blades, wherein said barrier blade hub is located at an opposite end of the formed cylindrical configuration from said heater blade hub.

22. The heater according to claim 19, wherein said heater blades comprise a ceramic.

23. The heater according to claim 22, wherein said ceramic comprises zirconia.

24. The heater according to claim 22, wherein said ceramic comprises alumina.

25. The heater according to claim 2, further comprising a heater blade hub connected to a respective end of each of the plurality of said heater blades and further comprising a barrier blade hub connected to a respective end of each of the plurality of said barrier blades, wherein said barrier blade hub is located at an opposite end of the formed cylindrical configuration from said heater blade hub.

26. The heater according to claim 1, further comprising first and second oppositely located end hubs, said plurality of barrier blades extending longitudinally from said first hub to said second hub.

27. The heater according to claim 26, wherein said plurality of longitudinally extending barrier blades define a plurality longitudinally extending spaces bounded by successive blades and said first and second hubs, wherein each heater element is inserted into a respective defined space.

28. The heater according to claim 27, further comprising a connecting heater hub overlying the first hub and connected to each of the inserted heater elements.

29. The heater according to claim 28, wherein each of said heater elements comprises a respective positive contact pad electrically connected to a first end of each heater element, said positive contact pad electrically connected to a positive connection of the source of electrical energy.

30. The heater according to claim 27, wherein the heater blades are bowed inwardly.

31. The heater according to claim 2, further comprising first and second opposite end hubs, wherein said plurality of barrier blades extend longitudinally from the first end hub in a particular direction and said plurality of heater blades extend longitudinally from the second end hub in an opposite direction, wherein gaps are respectively defined between adjacent heater and barrier blades.

32. The heater according to claim 31, wherein gaps are defined between the second end hub and an end of each barrier blade opposite the first end hub, and wherein gaps are defined between the first end hub and an end of each heater blade opposite the second end hub.

33. The heater according to claim 31, wherein said heater blades and said barrier blades are integrally formed at opposite ends to said first and second opposite end hubs.

34. The heater according to claim 31, wherein said plurality of barrier blades is connected at a first end to the first end hub and at a second end hub to the second end hub.

35. The heater according to claim 34, further comprising a common ring electrically connected to a second end of each heater element, said common ring electrically connected to a negative connection of the source of electrical energy, the first end of each heater element located opposite said second end hub.

36. The heater according to claim 35, further comprising a layer of contact material extending from a second end of each heater element, the second end of each heater element located at said second end hub.

37. The heater according to claim 36, wherein said layer of contact material further extends around said second end hub to define a common.

38. The heater according to claim 36, wherein said layer of contact material extends from each second end of each heater element, along an adjacent barrier blade, and around said first end hub to define a common.

39. The heater according to claim 34, further comprising a layer of contact material extending from a second end of each heater element, the second end of each heater element located at said second end hub.

40. The heater according to claim 39, wherein said layer of contact material further extends around said second end hub to define a common.

41. The heater according to claim 39, wherein said layer of contact material extends from each second end of each heater element, along an adjacent barrier blade, and around said first end hub to define a common.

42. The heater according to claim 1, wherein the heater elements are bowed inwardly.

43. The heater according to claim 1, wherein each of said heater elements comprises a respective positive contact pad electrically connected to a first end of each heater element, said positive contact pad electrically connected to a positive connection of the source of electrical energy.

44. The heater according to claim 43, wherein each of said heater elements further comprises a respective negative contact pad electrically connected to a second end of each heater element, said negative contact pad electrically connected to a negative connection of the source of electrical energy.

45. The heater according to claim 43, further comprising a common ring electrically connected to a second end of each heater element, said common ring electrically connected to a negative connection of the source of electrical energy.

46. The heater according to claim 2, wherein said plurality of heater blades and barrier blades define an insertion opening for the cigarette, the insertion opening narrowing to the defined cylindrical receptacle.

47. The heater according to claim 46, wherein the insertion opening has a larger diameter than the inserted cigarette.

48. The heater according to claim 2, wherein said heater blades and said barrier blades have approximately equal widths.

49. The heater according to claim 2, further comprising another plurality of heater elements, each of said other plurality of heater elements respectively fixed to each of said barrier blades.

* * * * *